US005354139A

United States Patent [19]

Barrus et al.

[11] Patent Number: 5,354,139

[45] **Date of Patent: * Oct. 11, 1994**

[54] PAPER FEED SYSTEM HAVING MECHANISMS ENGAGING OPPOSITE EDGES OF PRINT PAPER ABOVE AND BELOW PRINT STATION OF PRINTER

[75] Inventors: Gordon B. Barrus, San Juan Capistrano; Leo J. Emenaker, El Segundo, both of Calif.

[73] Assignee: Printronix, Inc., Irvine, Calif.

[ * ] Notice: The portion of the term of this patent subsequent to Dec. 11, 2008 has been disclaimed.

[21] Appl. No.: 335,104

[22] Filed: Apr. 7, 1989

[51] Int. Cl.[5] ..... B41J 11/26

[52] U.S. Cl. ..... 400/616.1; 400/618; 226/74

[58] Field of Search ..... 400/247, 248, 616, 616.1, 400/616.2, 616.3, 618, 656, 657; 101/93.04, 93.05; 226/74, 75, 76, 77, 78, 79, 80, 81, 82, 83, 84, 85, 86, 87

[56] References Cited

U.S. PATENT DOCUMENTS

| | | | |
|---|---|---|---|
| 1,332,861 | 3/1920 | Williams | 400/616.3 |
| 2,172,913 | 9/1939 | Rose | 400/616.2 |
| 3,147,900 | 9/1964 | Konkel | 226/76 X |
| 3,154,235 | 10/1964 | Hubbard | 400/616 X |
| 3,392,893 | 7/1968 | Bennett et al. | 226/74 |
| 3,414,106 | 12/1968 | Moran et al. | 400/616.1 X |
| 3,608,801 | 9/1971 | Nystrand | 226/74 |
| 3,688,959 | 9/1972 | Staneck et al. | 226/75 |
| 3,693,856 | 9/1972 | Funk | 226/74 |
| 3,827,616 | 8/1974 | Atkinson | 226/74 |
| 3,908,883 | 9/1975 | Bellisai et al. | 226/74 |
| 3,941,051 | 3/1976 | Barrus et al. | 101/93.04 |
| 4,214,691 | 7/1980 | Van Namen | 226/74 |
| 4,344,715 | 8/1982 | Van Horne et al. | 400/616.1 |
| 4,462,531 | 7/1984 | Seitz | 226/74 X |
| 4,571,102 | 2/1986 | Ono et al. | 400/248 |
| 4,687,359 | 8/1987 | Barrus et al. | 400/218 |
| 4,707,158 | 11/1987 | Hofmann | 226/74 X |

FOREIGN PATENT DOCUMENTS

| | | | |
|---|---|---|---|
| 57-39980 | 3/1982 | Japan . | |
| 0189179 | 8/1987 | Japan | 400/248 |
| 935129 | 8/1963 | United Kingdom | 400/616 |

*Primary Examiner*—Eugene H. Eickholt
*Attorney, Agent, or Firm*—Spensley Horn Jubas & Lubitz

[57] ABSTRACT

Each of a pair of spaced apart paper feed mechanisms within the paper feed system of a dot matrix line printer has opposite upper and lower portions thereof slightly angled relative to each other and disposed on opposite sides of and close to an elongated print station having a platen at one side thereof on which the paper feed mechanisms are mounted. Guides within the print station direct a length of paper introduced onto one portion of the paper feed mechanism through the print station and onto the other portion. Each paper feed mechanism is locked in a desired position on the platen using a manually operated lever arm arrangement having a mechanical advantage. Phasing or pitch adjustment between the opposite portions of each paper feed mechanism is accomplished by either of two arrangements which vary the position of a pulley engaging an endless belt between the opposite portions in combination with an opposite spring mounted pulley which bears against the inside of and tensions the endless belt. The opposite portions of each paper feed mechanism terminate in ramps which are angled to facilitate withdrawal of pins on the belt from apertures at the edges of the print paper. A lug arrangement at the end of the ramp prevents the toothed underside of the belt from slipping off of the meshing teeth of a pulley about which the belt extends. Slide members resiliently bear against and maintain the edges of the paper in contact with the belts.

11 Claims, 12 Drawing Sheets

PAPER FEED SYSTEM HAVING MECHANISMS ENGAGING OPPOSITE EDGES OF PRINT PAPER ABOVE AND BELOW PRINT STATION OF PRINTER

BACKGROUND OF THE INVENTION

1. Field of the Invention

The present invention relates to systems for feeding a length of paper, and more particularly to systems for feeding a length of print paper through a print station within an impact printer.

2. History of the Prior Art

Impact printers typically include a system for feeding a length of print paper through a print station where impact printing on the paper takes place. The paper feed system may be of the type described in U.S. Pat. No. 3,941,051 of Barrus et al., which patent issued Mar. 2, 1976 and is commonly assigned with the present application. In the printer described in the Barrus et al. patent, the length of print paper is advanced upwardly from a paper ironer through a print station by a pair of tractor drives mounted above the print station. The tractor drives have pins on endless belts which engage spaced apart apertures at the opposite edges of the length of paper. A reciprocating hammerbank at the print station impacts the length of paper against a supporting platen through a length of ink ribbon to print on the paper in dot matrix fashion. The elongated paper ironer drags against the paper to maintain the paper in tension through the print station as the paper is advanced upwardly in incremental fashion by the pair of tractor drives. The direction of paper feed is not reversible.

The paper ironer of the printer described in U.S. Pat. No. 3,941,051 of Barrus et al. which maintains the paper in tension as it is fed through the print station can be replaced with other paper tensioning arrangements. Examples of more sophisticated paper tensioning arrangements are described in U.S. Pat. No. 4,687,359 of Barrus et al. which issued Aug. 18, 1987, and which is commonly assigned with the present application, and copending application Ser. No. 628,418 of Barrus et al. now abandoned, filed Jul. 6, 1984 and commonly assigned with the present application. As in the case of the paper ironer of the '051 patent of Barrus et al., the paper tensioning arrangements described in the Barrus et al. '359 patent and the copending application do not provide for bidirectional feeding of tile paper through the print station.

An example of a motor driven arrangement disposed on the opposite side of the print station from a pair of tractor drives and which may be employed to feed the paper bidirectionally through the print station is described in Japanese Patent No. 57-39980 of Sugano, dated Mar. 5, 1982. In the Sugano patent the motor driven arrangement operates bidirectionally at speeds slightly different from the speed of the tractor drives so as to maintain the paper within the print station in tension as it is fed in opposite directions.

A frequently used paper feed system for maintaining reasonably effective control of a length of print paper while feeding the length of print paper through a print station bidirectionally employs pairs of tractor drives of similar design above and below the print station. Typically, such tractor drives utilize belts, chains or other endless members having spaced apart pins for engaging the holes at the opposite edges of the length of paper.

By locating different pairs of the tractor drives above and below the print station, the paper may be fed bidirectionally through the print station with a desired amount of tension and in a desired manner. However, in addition to being rather costly and requiring considerable space, such arrangements may still leave much to be desired in terms of the lack of precision with which they feed the paper. For example, in the case of line printers employing a reciprocating hammerbank within the print station, the hammerbank typically imposes substantial lateral loads on the paper making precise handling of the paper difficult.

In an effort to exercise closer and more accurate control over the bidirectional feeding of paper through a print station, paper feed systems have been devised in which each one of a pair of tractor drives extends on both sides of the print station and engages opposite portions of the length of paper at locations relatively close to the print station. Examples of such paper feed systems are provided by U.S. Pat. No. 3,392,893 of Bennett et al., which patent issued Jul. 16, 1968, and U.S. Pat. No. 3,908,883 of Bellisai et al., which patent issued Sep. 30, 1975. The Bennett et al. patent describes an arrangement which uses pulleys to position portions of an endless belt having pins spaced along the length thereof both above and below a print station. Phasing or pitch adjustment between the two portions is accomplished by a central pulley movable along a horizontal slot between the two different portions and a second pulley movable within a vertical slot and engaging the inside of the endless belt at a different location. The arrangement described in Bellisai et al. employs an endless chain having spaced apart pins along the length thereof and including a chain tensioning device. A central guide section disposes a central portion of the chain out of the way of the print station. A further example of an arrangement for adjusting phasing between opposite tractor drives is provided by U.S. Pat. No. 3,827,616 of Atkinson, which patent issued Aug. 6, 1974.

The patents of Bennett et al. and Bellisai et al. represent a step in the direction of more effective and efficient control of bidirectional paper feed through a print station. However, while the paper feed systems described in the patents dispose portions of integral tractor drives above and below and adjacent tile print station, such systems suffer from a number of disadvantages which limit their usefulness and effectiveness. One major drawback in the case of the Bennett et al. system, for example, is the inability of the system described therein to adjust the phasing between the portions on opposite sides of the print station after the paper is installed. Because the phasing must be adjusted using two different pulleys movable along mutually orthogonal slots, the phasing can only be adjusted prior to installation of the paper. Still other shortcomings of tile systems described in tile Bennett et al. and Bellisai et al. patents relate to the configuration, mounting and method of operation of such systems.

Various attempts have been made to provide improved paper feed systems through the introduction of various potentially advantages features. However, such features have usually fallen short in terms of solving the particular problems to which they are directed, and especially in terms of providing a unique overall combination constituting a truly improved paper feed system. Thus, in U.S. Pat. No. 4,344,715 of Van Horne et al. a tractor drive is mounted on one side of the platen and is locked in place by an arrangement of limited effectiveness. In U.S. Pat. No. 4,214,691 of van Namen, which patent issued Jul. 29, 1980, the pitch of the belt teeth is selected relative to the pitch circle of the pins on the belt in an effort to remove the pins from the apertures in the paper without tearing the paper. Also, U.S. Pat. No. 3,608,801 of Nystrand, which patent issued Sep. 28,1971, and U.S. Pat. No. 3,688,959 of Staneck et al., which patent issued Sep. 5, 1972, describe the provision of angled ramp portions at the ends of the tractor drive in an effort to facilitate pin removal from the paper. However, such arrangements concentrate on pin removal at the expense of the paper feed function itself, particularly at the ends of the tractor drive where some paper drive is still important. The Nystrand patent also attempts to maintain the paper in a close mating engagement with the moving belt and the pins thereon, but does so at the expense of requiring a completely separate belt and pulley arrangement.

Accordingly, it is an object of the present invention to provide an improved paper feed system.

A further object of the present invention is the provision of a paper feed system which provides for accurate paper positioning and movement in conjunction with bidirectional paper feed operation.

Further objects in accordance with the present invention include the provision of a paper feed system of versatile bidirectional design and which has first and last line and demand document capabilities.

BRIEF DESCRIPTION OF THE INVENTION

Briefly stated, the present invention provides an improved paper feed system in which each of a pair of paper feed mechanisms has opposite upper and lower portions thereof disposed on opposite sides of and adjacent an elongated platen and the print station extending along the length thereof. The system which can be used in any type of printer, either impact or non-impact, enables bidirectional paper feed with improved paper control and more accurate paper positioning. In dot matrix printers, the more accurate paper positioning provides improved dot placement accuracy. Also, there is greater resistance to forms displacement or motion during printing, and the system is capable of printing the first and last lines of any form as well as providing the ability to remove a completed form without affecting the ability to print the first line of the following form (so-called demand document capability). The system is of relatively small, low cost design, and provides a relatively short paper web through the print station between the opposite upper and lower portions of each paper feed mechanism as well as low compliance between the drive motor and the print station.

In paper feed systems according to the invention, pitch adjustment between the opposite upper and lower portions of the pair of paper feed mechanisms is easily accomplished, both with and without the presence of paper in the system, by an arrangement within each paper feed mechanism which varies the length of the path for an endless paper feed belt between the opposite portions of the paper feed mechanism while simultaneously tensioning the belt in a separate location using a resilient biasing arrangement. In a first such arrangement, the length of the belt path between the opposite portions of the paper feed mechanism is varied by changing the angular orientation of an eccentric hub on which a pulley which engages the belt is rotatably mounted. The eccentric hub is mounted on a shaft together with a knob used to rotate the shaft and thereby the eccentric hub between opposite print and paper load-unload positions. The knob is movable through a small range at the print position to provide minor variations in paper tension which accommodate different form sizes, paper hole diameters, and the like. With the knob in the paper load-unload position, paper tension is relaxed to permit paper loading and unloading. The arrangement for resiliently biasing the belt to provide desired tension therein comprises a spring fixedly mounted to a reference at a first end thereof and having a pulley which engages the inside of the belt and is rotatably mounted at the opposite second end of the spring.

In a preferred second arrangement for varying the length of the path for the endless paper feed belt between the opposite portions of the paper feed mechanism in conjunction with tile arrangement for resiliently biasing the belt, the belt is engaged by a pulley rotatably mounted on one end of a pivotable lever arm assembly. An opposite end of the pivotable lever arm assembly bears against a cam rotatably mounted within the frame of the paper feed mechanism and coupled to the knob-adjusted shaft. The cam has a surface the radius of which increases along the circumference of the cam. Consequently, rotation on the cam via the knob-adjusted shaft moves the engaging second end of the lever arm assembly toward or away from the axis of rotation of the cam, and the resulting pivoting motion of the pivotable lever arm assembly moves the rotational axis of the pulley bearing against the belt to vary the length of the belt path. Initial calibration is performed by turning a set screw journaled in the second end of the lever arm assembly to vary the location of a separate tab relative thereto. The tab comprises the portion of the second end which bears against the cam.

In accordance with further features of the invention the pair of paper feed mechanisms are mounted on the elongated platen so as to be slidable along the length of the platen and lockable thereto at desired locations. The ability to mount and lock each of the paper feed mechanisms on the platen so that the elongated opposite upper and lower portions of each mechanism extending above and below the platen and which lie generally along a common axis of elongation are generally perpendicular to the elongated platen provides for a very stable mount with entry to and exit from the print station being more accurate as a result. Such mounting and locking arrangement can also be used to compensate for a lack of parallelism between a drive rod extending between and driving each of the paper feed mechanisms and the elongated platen.

The opposite upper and lower portions of each paper feed mechanism form a relatively small angle between them. In addition to providing better paper placement within the print station and over the platen therein, the slightly angled upper and lower portions provide for a relatively short web of the paper therebetween in the face of the space requirements of the platen, adjacent paper guides, and adjacent portions of the belt and adjacent pulleys encircled by the belt.

In a preferred arrangement for locking each paper feed mechanism on the elongated platen, a locking member pivotally mounted on the paper feed mechanism has a portion thereof for engaging the platen. A link is coupled between the locking member and a manually rotatable actuating lever which is rotatably mounted on the paper feed mechanism. A tension spring extending between the locking member and the paper feed mechanism normally biases the engaging portion of the locking member away from the platen to unlock the paper feed mechanism. Rotation of the actuating lever against the resistance of the tension spring causes the engaging portion of the locking member to securely seat against the platen and lock the paper feed mechanism in position. The link is coupled to the locking member at a location which is a first distance from the pivot axis thereof and to the actuating lever at a location which is a second distance from the axis of rotation thereof. The second distance is substantially less than the first distance, providing the arrangement with a significant mechanical advantage during the locking and unlocking thereof.

Paper feed mechanisms in accordance with the invention utilize pins, each of which has a cylindrical base portion adjacent the endless belt and an involute portion extending outwardly from the cylindrical base portion opposite the belt. The cylindrical base portion of each pin is slightly smaller in size than each aperture in the paper, and the pitch of the paper feed mechanisms is selected to bias the pins against the edges of the paper apertures at the opposite upper and lower portions of each paper feed mechanism. Removal of the pins from the paper apertures at the end of each paper feed mechanism while continuing to drive the paper is facilitated by ramp portions of the paper feed mechanism extending between relatively straight paper feed portions of the mechanism and pulleys at the ends of the mechanism about which the belt is wrapped. The angle between each ramp portion and the adjacent paper feed portion is large enough to partially but not completely remove each pin from the mating paper aperture as the pin enters the ramp portion from the paper feed portion and advances to the pulley. The cylindrical base portion of each pin which must reside within the paper aperture during paper feeding to provide the close paper control desired is removed from the paper aperture by action of the ramp portion as the pin reaches the pulley. The involute portion of the pin is then easily withdrawn from the paper aperture as the pin moves over and around the pulley.

In this manner removal of the pins from the paper apertures without tearing the paper is facilitated, while at the same time the pins remain at least partially within the paper apertures in order to continue to drive the paper until the pins begin to move around the pulley at the end of the paper feed mechanism. Preferably, the angle between the paper feed and ramp portions of the paper feed mechanism is such that the ramp portion slopes away from the paper feed portion by an amount approximately equal to the height of the cylindrical base portion of each pin.

In accordance with the present invention the paper is urged against the endless belt in a manner which maintains the apertures in the paper at the cylindrical base portions of the pins by arrangements which resiliently urge the paper against the belt. In a preferred embodiment, such arrangements are comprised of slide members mounted at the undersides of covers rotated into place on top of the paper when the paper is installed in the paper feed system. Each slide member has a spring or other resilient member for urging the slide member against the paper and the belt on the opposite side of the paper. A longitudinal slot within each slide member allows the pins to pass therethrough as the belt is advanced relative to the slide member.

In accordance with the invention each paper feed mechanism includes a lug arrangement disposed over and adjacent the belt where the belt begins to wrap around the pulley at the end of the paper feed mechanism. The presence of the lug arrangement close to the belt prevents a toothed underside of the belt from disengaging a toothed outer surface of a drive pulley with which it meshes. The lug arrangement is comprised of opposite lugs disposed adjacent opposite sides of the endless belt with a space therebetween for accommodating the pins. The lugs are spaced from the pulley by a distance greater than the thickness of the belt but less than the combined thickness of the belt and the height of the teeth. Such arrangement is particularly useful in preventing disengagement of the toothed underside of the belt from the toothed drive pulley in the face of the substantial paper tension created during manual tearing off of a section of the paper while it is in the printer. Such arrangement also permits the use of relatively small teeth with the attendant advantage of a close tolerance fit and little backlash.

In accordance with the invention feeding of paper into and through the paper feed mechanisms is facilitated by an arrangement of guides. The guides are located at the entrance to and the exit from the print station and are spaced from the platen. The first guide is located at the juncture between the lower portion of the paper feed mechanism and the print station, while the second guide is located at the juncture between the upper portion of the paper feed mechanism and the print station. The guides are adjacent the ends of the covers of the lower and upper portions of the paper feed mechanism. As a length of paper is advanced upwardly through the lower portion of the paper feed mechanism, the first guide acts to direct the paper into the print station. As the length of paper exits from the opposite side of the print station, the second guide acts to direct the paper onto the upper portion of the paper feed mechanism. In a preferred embodiment, the first and second guides are comprised of spaced apart, parallel ridges on a ribbon mask disposed between the platen and the ink ribbon on the opposite side of the ink ribbon from the hammerbank.

BRIEF DESCRIPTION OF THE DRAWING

A better understanding of the invention may be had by reference to the following description, taken in conjunction with the accompanying drawings, in which.

DETAILED DESCRIPTION

Figure 1:
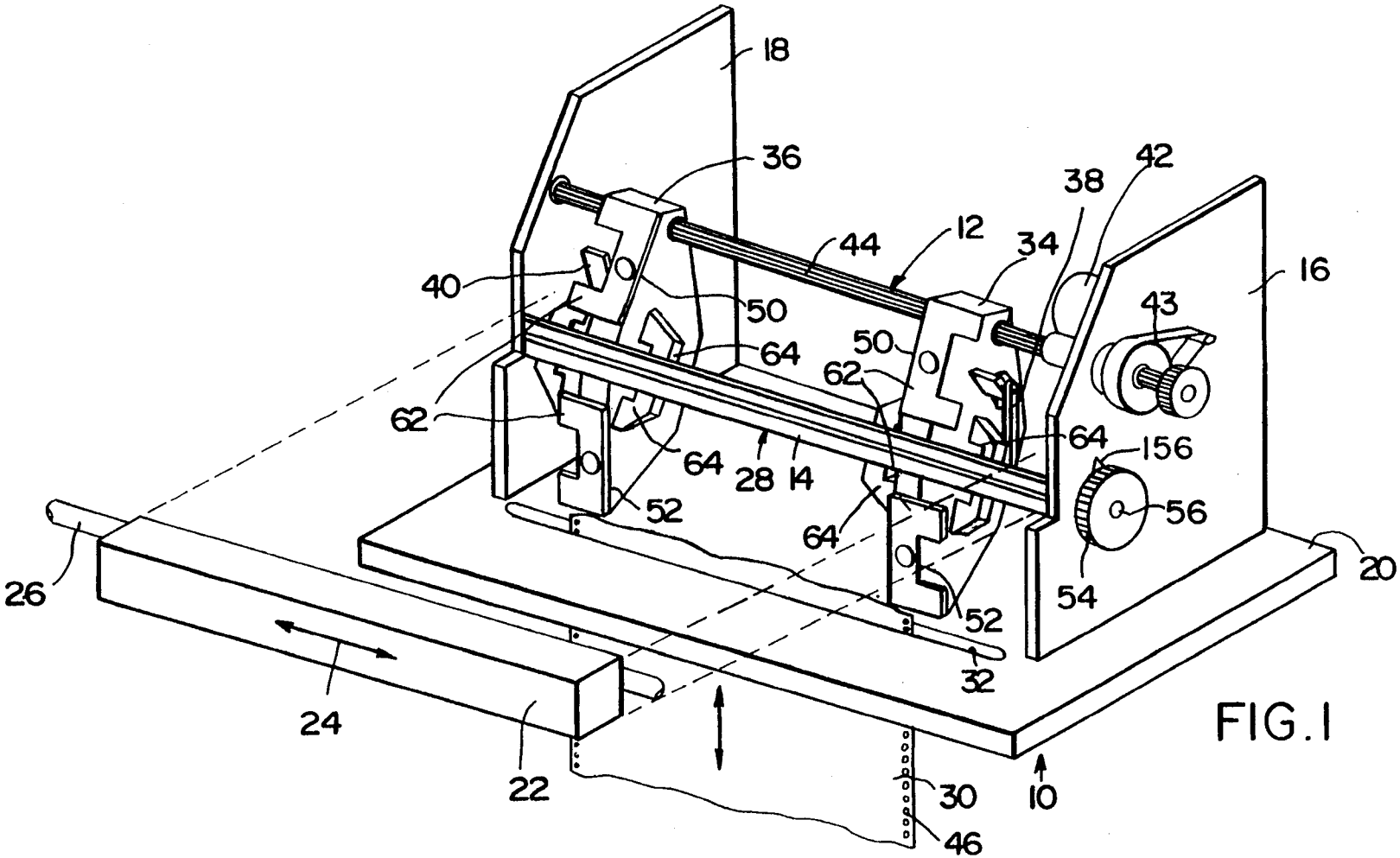
FIG. 1 is an exploded perspective view of a dot matrix line printer showing a paper feed system in accordance with the invention.

FIG. 1 depicts a printer 10 having a paper feed system 12 in accordance with the invention. In addition to the paper feed system 12, the printer 10 has an elongated platen 14 extending between and secured at the opposite ends thereof to an opposite pair of side members 16 and 18 mounted on a base plate 20.

The printer 10 also has an elongated hammerbank 22 which is normally disposed adjacent the platen 14. The hammerbank 22 undergoes reciprocating motion relative to the platen 14 as represented by an arrow 24. A length of ink ribbon 26 is disposed in the small space between the hammerbank 22 and the platen 14, which space defines a print station 28 for the printer 10. The hammerbank 22 is provided with a plurality of hammers 66 (shown in FIG. 2) mounted along the length thereof. Each hammer 66 may be selectively released or "fired" so that a dot printing tip 72 (shown in FIG. 2) at the end of the hammer 66 impacts a length of print paper 30 within the print station 28 against the platen 14 through the ink ribbon 26. The length of print paper 30 is fed through a slot 32 in the base plate 20 and through the print station 28 by the paper feed system 12. For clarity of illustration of the paper feed system 12, however, only a portion of the length of print paper 30 extending through the slot 32 and beneath the base plate 20 is shown in FIG. 1.

The hammerbank 22 may be of any appropriate line printer configuration such as described in the previously referred to U.S. Pat. No. 3,941,051 of Barrus et al. or the previously referred to the now abandoned copending application Ser. No. 628,418 of Barrus et al. In addition, the means for driving the hammerbank 22 in reciprocating fashion has not been shown in FIG. 1 inasmuch as such reciprocating drive means can be of any appropriate configuration such as described in the previously referred to U.S. Pat. No. 3,941,051 of Barrus et al. Similar comments apply to the ribbon deck for the ink ribbon 26 which may be of conventional configuration such as described in U.S. Pat. No. 3,941,051 of Barrus et al.

Line printers such as the printer 10 shown in FIG. 1 print in dot matrix fashion during each of the opposite sweeps of the hammerbank 22 along the platen 14 as the hammerbank 22 undergoes its reciprocating motion. Printing occurs on the fly with selected ones of the hammers along the length of the hammerbank 22 being released to print dots as the hammerbank 22 undergoes the opposite sweeping movements. During each sweeping movement of the hammerbank 22 along the platen 14, a row of dots is printed on the length of print paper 30. Upon each reversal of the hammerbank 22 in preparation for movement in the opposite direction, the paper feed system 12 advances the length of print paper 30 upwardly by a selected increment of movement in preparation for printing of the next dot row.

The paper feed system 12 which is shown and described in greater detail hereafter is shown and described in connection with the dot matrix line printer of FIG. 1 for purposes of illustration only. Accordingly, it will be understood and appreciated by those skilled in the art that the paper feed system 12 can be advantageously employed in other types of printers as well, such as serial impact printers or non-impact printers, and even in non-printer applications where precise paper feeding is required.

The paper feed system 12 includes an opposite pair of paper feed mechanisms 34 and 36 mounted in spaced apart locations along the length of the platen 14. As described in detail hereafter, each of the paper feed mechanisms 34 and 36 is mounted on the platen 14 and is capable of sliding movement along the platen 14 and of being locked in a selected location along the length of the platen 14. The paper feed mechanism 34 and the paper feed mechanism 36 are respectively provided with releasable locking arrangements 38 and 40.

A motor 42 mounted on the inside of the side member 16 adjacent the top thereof is coupled via a belt and pulley arrangement 43 on the outside of the side member 16 to rotatably drive a drive rod 44 extending between the opposite side members 16 and 18 and through upper portions of the paper feed mechanisms 34 and 36. As described in detail hereafter, the drive rod 44 is coupled to drive pulleys 86 (shown in FIGS. 2, 4, 13, 18 and 21) within the paper feed mechanisms 34 and 36, which pulleys advance paper feed members in the form of endless belts 78 (shown in FIGS. 2, 4, 11–14 18 and 21) within the paper feed mechanisms 34 and 36. The endless belts 78 include pins 82 (shown in FIGS. 2, 4, 11–14, 18 and 21) disposed along the lengths thereof for engagement with apertures 46 at the opposite edges of the length of print paper 30 for positive engagement of the length of print paper 30 during feeding thereof.

In accordance with the invention each of the paper feed mechanisms 34 and 36 is provided with an upper portion 50 thereof disposed above and adjacent the platen 14 and an opposite lower portion 52 thereof disposed below and adjacent the platen 14. The upper and lower portions 50 and 52 of each of the paper feed mechanisms 34 and 36 are of elongated configuration and lie along a common axis which is generally perpendicular to the direction of elongation of the platen 14. Disposition of the upper and lower portions 50 and 52 on opposite sides of and close to the platen 14 has been found highly advantageous in terms of improved paper feeding through and positioning within the print station 28. Such improvements result in part from a reduced paper web or portion of the length of print paper 30 within the print station 28 and between the opposite upper and lower portions 50 and 52.

As shown in FIG. 1 the paper feed system 12 includes a knob 54 disposed beneath the belt and pulley arrangement 43 on the outside of the side member 16 and mounted on a pitch adjustment shaft 56. The pitch adjustment shaft 56 extends between the side members 16 and 18 and through intermediate portions of the paper feed mechanisms 34 and 36. As described in detail hereafter, the knob 54 rotates the pitch adjustment shaft 56 to adjust the pitch between the upper and lower portions 50 and 52 of the paper feed mechanisms 34 and 36. In this manner the tension of the length of print paper 30 within the print station 28 can be adjusted.

As shown in FIG. 1 each of the upper and lower portions 50 and 52 of the paper feed mechanisms 34 and 36 is provided with a hinged cover 62. The hinged covers 62 reside over the length of print paper 30 and resiliently mount slide members 186 (shown in FIGS. 12–15 and 17) for maintaining the opposite edges of the length of print paper 30 engaged with the endless belt within the paper feed mechanisms 34 and 36 as described in detail hereafter.

The upper and lower portions 50 and 52 of the paper feed mechanisms 34 and 36 are each provided with an opposite pair of lateral support legs 64 extending from opposite sides thereof into engagement with the platen 14. The lateral support legs 64 maintain the elongated paper feed mechanisms 34 and 36 generally perpendicular to the platen 14 as well as providing substantial lateral stability in the mounting of the paper feed mechanisms 34 and 36 on the platen 14. This contributes to the improved paper feeding and positioning in accordance with the invention.

Figure 2:
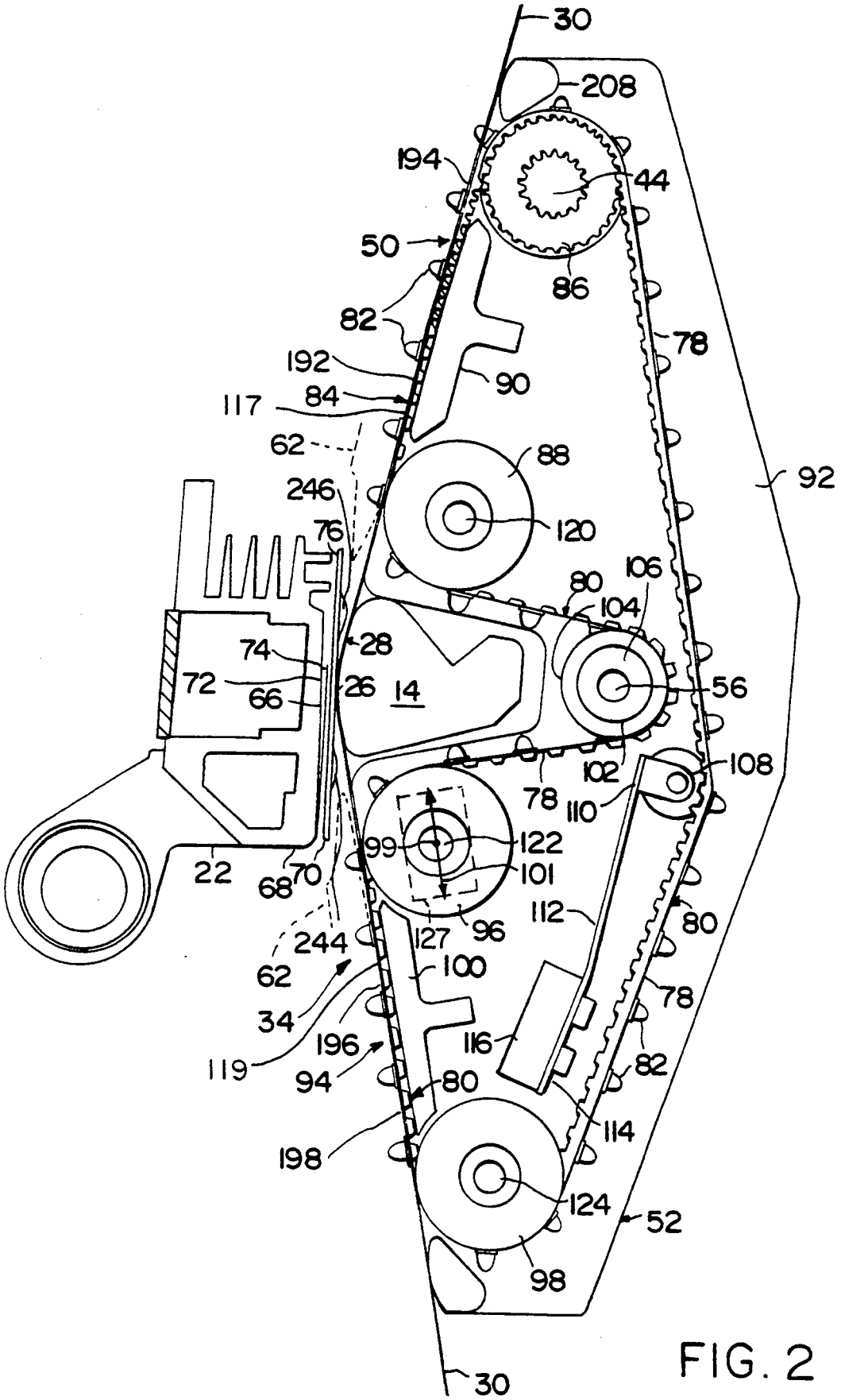
FIG. 2 is a side view of the inside of one of the paper feed mechanisms of the paper feed system of FIG. 1 together with the hammerbank of the printer and showing a first embodiment of an arrangement for providing pitch adjustment.

FIG. 2 illustrates the internal configuration of the paper feed mechanism 34, including a first embodiment of a pitch adjustment mechanism, in conjunction with the hammerbank 22. The description of FIG. 2 hereafter also applies to the paper feed mechanism 36 which is of like configuration. The length of print paper 30 is illustrated in FIG. 2 as extending through both upper and lower portions 50 and 52 and the print station 28 therebetween.

As previously noted in connection with FIG. 1, the hammerbank 22 has a plurality of hammers mounted along the length thereof. Fig, 2 illustrates one such hammer 66 mounted on a frame 68 for the hammerbank 22 at a lower end 70 thereof and having a dot printing impact tip 72 mounted at an opposite upper end 74 thereof. When the hammer 66 is released or "fired" causing the upper end 74 thereof to fly forward toward the platen 14, the dot printing impact tip 72 extends through an adjacent ribbon mask 76 and impacts the length of print paper 30 against the supporting platen 14 through the length of ink ribbon 26. In this manner dots are printed on the length of print paper 30.

The paper feed mechanism 34 includes an endless paper feed member in the form of an endless belt 78 extending along an endless path of movement 80. The belt 78 has a plurality of pins 82 spaced apart along the length thereof for engagement with the apertures 46 at the edges of the length of print paper 30.

Figure 3:
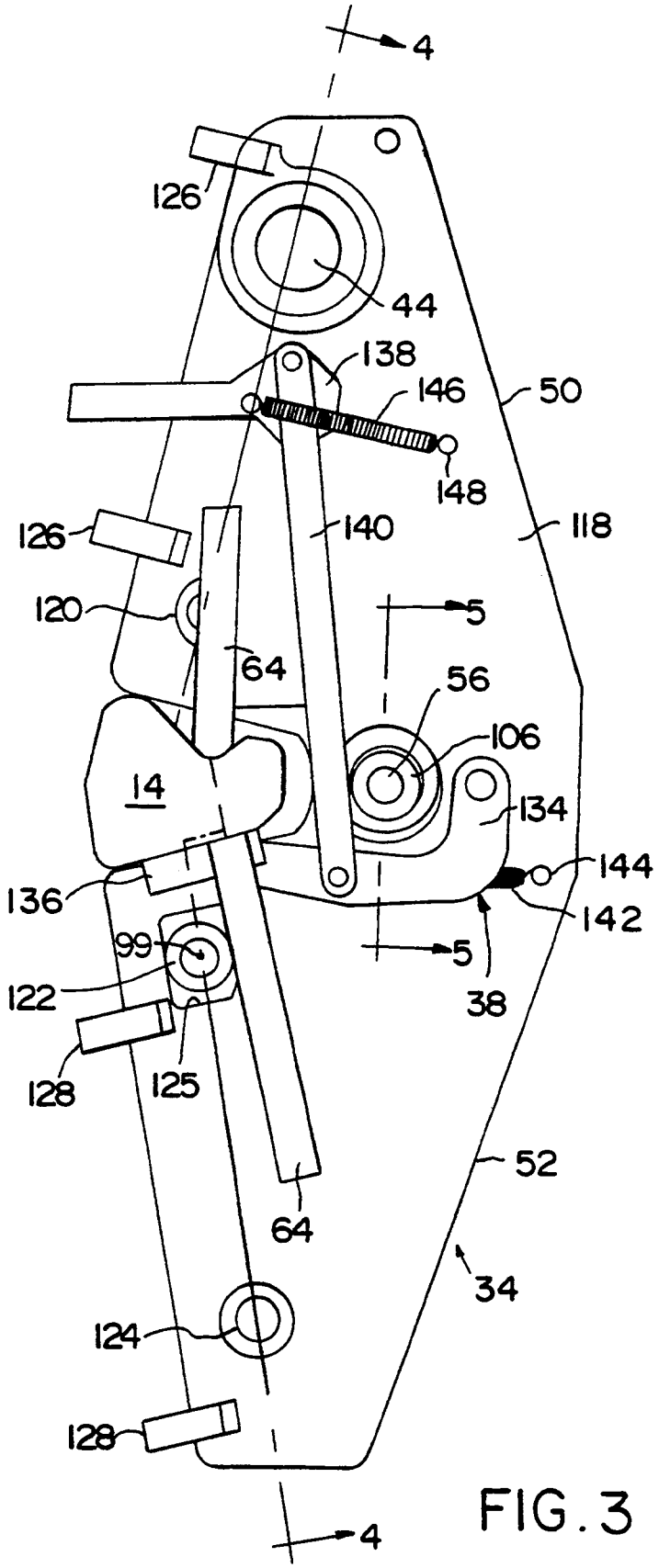
FIG. 3 is a side view of the outside of the paper feed mechanism shown in FIG. 2.
Figure 22:
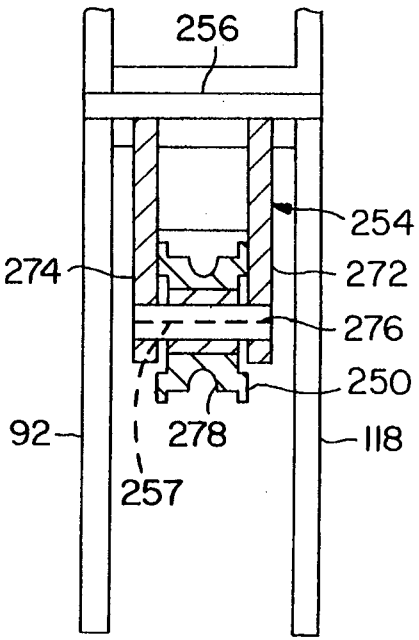
FIG. 22 is a sectional view of a portion of the paper feed mechanism of FIG. 21 taken along the line 22—22.

The upper portion 50 of the paper feed mechanism 34 includes a side portion 84 of the endless path of movement 80 which is defined by a pair of pulleys 86 and 88 and a belt support member 90 disposed therebetween. The pulley 86 comprises a drive pulley and is mounted on the drive rod 44. Rotation of the drive pulley 86 in response to rotation of the drive rod 44 acts to advance the endless belt 78 to produce the desired feed of the length of print paper 30. The pulley 88 is an idler pulley which is rotatably mounted between an opposite pair of side frames 92 and 118 for the paper feed mechanism 34. The such side frame 92 is shown in FIGS. 2, 4, 5 and 22. The side frame 118 is shown in FIGS. 3, 5 and 22.

The lower portion 52 of the paper feed mechanism 34 has a side portion 94 of the endless path of movement 80 for the belt 78 which is defined by a pair of pulleys 96 and 98 and a belt support member 100 disposed therebetween. The pulleys 96 and 98 are both idler pulleys and are rotatably mounted between the opposite side frames 92, 118 including the side frame 92 shown in FIG. 2. An axis of rotation 99 of the pulley 96 can be shifted slightly relative to the opposite side frames 92 and 118, as represented by an arrow 101, to perform initial calibration of the phasing adjustment described hereafter.

In accordance with the invention the principal pitch adjustment between the upper and lower portions 50 and 52 of the paper feed mechanism 34 is accomplished by varying the length of the endless path of movement 80 between the pair of side portions 84 and 94. In the particular embodiment of FIG. 2, variations in the length of the endless path of movement 80 between the side portions 84 and 94 are accomplished by a pitch adjustment pulley 102 having a circumferential groove 104 therein to receive the pins 82 of the endless belt 78. The pitch adjustment pulley 102 is rotatably mounted on an eccentric hub 106 mounted on the pitch adjustment shaft 56. Rotation of the pitch adjustment shaft 56 has the effect of moving the axis of rotation of the pitch adjustment pulley 102 along an arc due to the eccentric nature of the hub 106. This has the effect of moving the axis of rotation of the pitch adjustment pulley 102 generally toward or away from the platen 14 as the pitch adjustment shaft 56 is rotated, and in this manner the length of the endless path of movement 80 between the side portions 84 and 94 is varied.

As shown in FIG. 2, the paper feed mechanism 34 includes means for resiliently biasing the endless belt 78 at a location opposite the portion of the endless path of movement 80 between the side portions 84 and 94 so as to maintain the belt 78 in tension. Such means include a pulley 108 rotatably mounted at an end 110 of an elongated spring 112 having an opposite end 114 coupled to a fixed reference in the form of a mounting block 116 secured to the side frame 92. The resilient spring 112 constantly biases the pulley 108 against the inside of the endless belt 78 so as to maintain the belt 78 in a desired state of tension. The belt tension serves to maintain the toothed engagement of the drive pulley 86 with the underside of the endless belt 78 which is shown and described hereafter. The tension minimizes friction and compensates for system variations and eccentricities.

The belt tension as provided in this manner combines with the ability to change the length of the endless path of movement 80 for the belt 78 at a location between the side portions 84 and 94 as provided by the pitch adjustment pulley 102, the eccentric hub 106 and the pitch adjustment shaft 56. Together, they enable the pitch to be adjusted prior to and after the length of print paper 30 is installed within the paper feed system 12. Consequently, pitch adjustment can be accomplished at any time during operation of the printer 10; even when the length of print paper 30 is present and in motion within the paper feed system 12.

As illustrated in FIG. 2 the upper and lower portions 50 and 52 of the paper feed mechanism 34 form a relatively small acute angle with each other as measured between an extension of an axis of elongation 117 of the portion 50 relative to an axis of elongation 119 of the portion 52. Consequently the length of paper 30 within the paper feed mechanism 34 is not planar but rather goes through a slight bend within the print station 28 between the upper and lower portions 50 and 52. This bend provides for a relatively short web of the paper 30 between the upper and lower portions 50 and 52. If the length of paper 30 were planar throughout the paper feed mechanism 34, a larger web of paper would be required in order to accommodate the pins 82, the platen 14 and paper guides 244 and 246 on the ribbon mask 76 which are described hereafter.

FIG. 3 is a side view of the paper feed mechanism 34 in conjunction with the platen 14 and illustrating the details of the releasable locking arrangement 38. The paper feed mechanism 36 is of like configuration, except that the releasable locking arrangement 40 thereof is on the opposite side thereof. The releasable locking arrangement 38 is shown and described herein for purposes of illustration only, and it should be understood that other releasable locking arrangements can be used in accordance with the invention.

The paper feed mechanism 34 has a housing comprised of a pair of spaced apart side frames which include the side frame 92 shown in FIG. 2 and an opposite side frame 118. Extending between the side frames 92 and 118 are a plurality of shafts 120, 122 and 124 on which the pulleys 88, 96 and 98 respectively are rotatably mounted. The shaft 122 for rotatably mounting the pulley 96 is movable along a slot 125 in the side frame 118 and a comparable slot 127 (shown in dotted outline FIG. 2) in the side frame 92 to provide for shifting of the axis of rotation of the pulley 96 as represented by the arrow 101 in FIG. 2. As previously noted the drive pulley 86 is mounted on the drive rod 44 which extends through the paper feed mechanisms 34 and 36 between the side members 16 and 18 of the printer 10. The side frame 118 includes a pair of hinges 126 spaced apart along the upper portion 50 for receiving one of the covers 62 which is not shown in FIG. 3 for simplicity of illustration. The side frame 118 also includes a pair of hinges 128 at the lower portion 52 for mounting another one of the covers 62 which is not shown in FIG. 3.

An upper one of the lateral support legs 64 formed as a part of tile side frame 118 extends outwardly therefrom and into contact-with the bottom of a generally V-shaped groove in the upper surface of the platen 14 as shown. A lower one of the lateral support legs 64 which is also formed as a part of the side frame 118 extends outwardly therefrom and into contact with a lower surface of the platen 14. The lateral support legs 64 on the opposite side of the paper feed mechanism 34 are formed as a part of the side frame 92 so as to extend outwardly therefrom and into contact with the platen 14 in similar fashion.

As shown in FIG. 3 the releasable locking arrangement 38 includes a locking member 134 pivotally mounted on the side frame 118 adjacent and behind the pitch adjustment pulley 102. The locking member 134 extends forwardly and terminates in a portion 136 thereof for engaging the underside of the platen 14. A manually rotatable actuating lever 138 is rotatably mounted on the side frame 118 immediately below the drive rod 44. A link 140 is coupled to the manually rotatable actuating lever 138 at one end thereof and to the locking member 134 at an opposite end thereof. A first tension spring 142 which is only partially shown in FIG. 3 extends between a fixed reference in the form of a mounting pin 144 on the side frame 118 and the pivot coupling of the lever arm 140 to the locking member 134. A second tension spring 146 is coupled between a fixed reference in the form of a mounting pin 148 on the side frame 118 and a location on the manually rotatable actuating lever 138.

Figure 9:
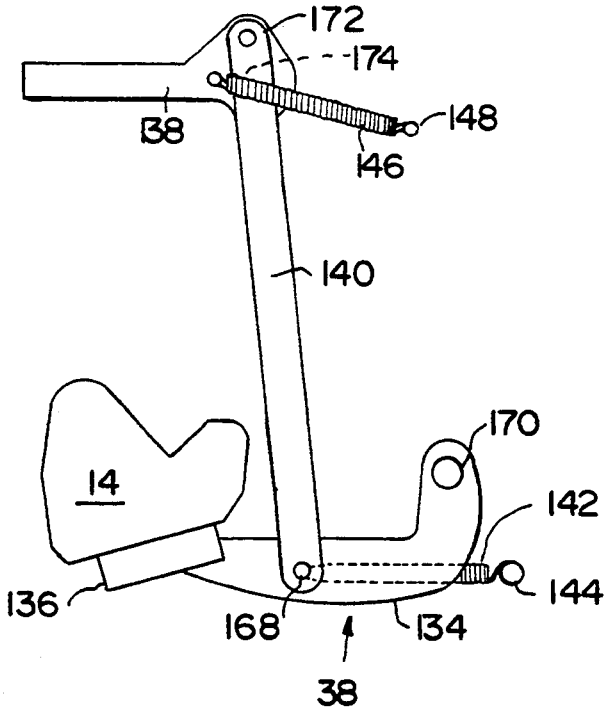
FIG. 9 is a plan view of an arrangement shown in FIG. 3 for locking the paper feed mechanism in place on the platen of the printer of FIG. 1, the locking arrangement being shown in the locked position.
Figure 10:
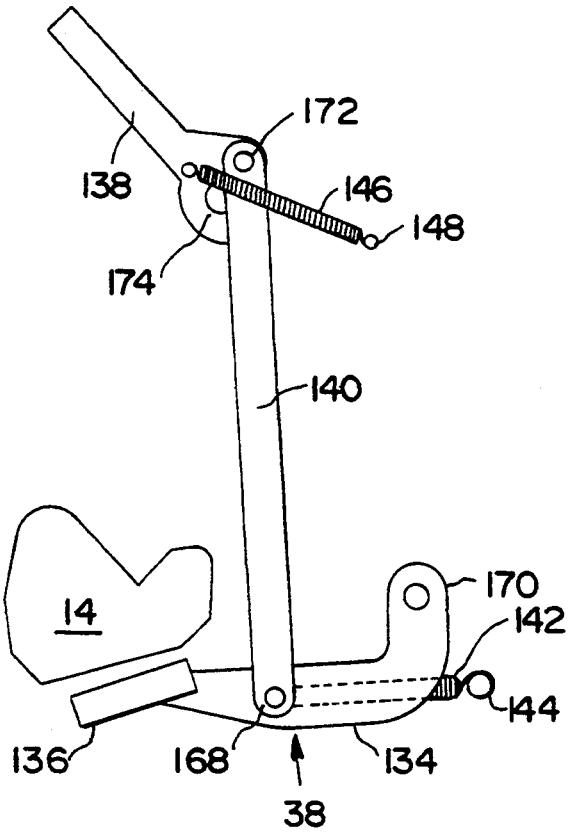
FIG. 10 is a plan view of the locking arrangement of FIG. 9 in the unlocked position.

As described in detail hereafter in connection with FIGS. 9 and 10 the releasable locking arrangement 38 which has a built-in mechanical advantage quickly and effectively locks the paper feed mechanism 34 on the platen 14, then releases the paper feed mechanism 34 just as easily so as to permit relocation of the paper feed mechanism 34 along the length of the platen 14. The first tension spring 142 biases the portion 136 of the locking member 134 away from engagement with the platen 14 except when the manually rotatable actuating lever 138 is moved into the locking position. The second tension spring 146 acts to bias the manually rotatable actuating lever 138 into either the locking position which is shown in FIG. 3 or the opposite unlocking position.

Figure 4:
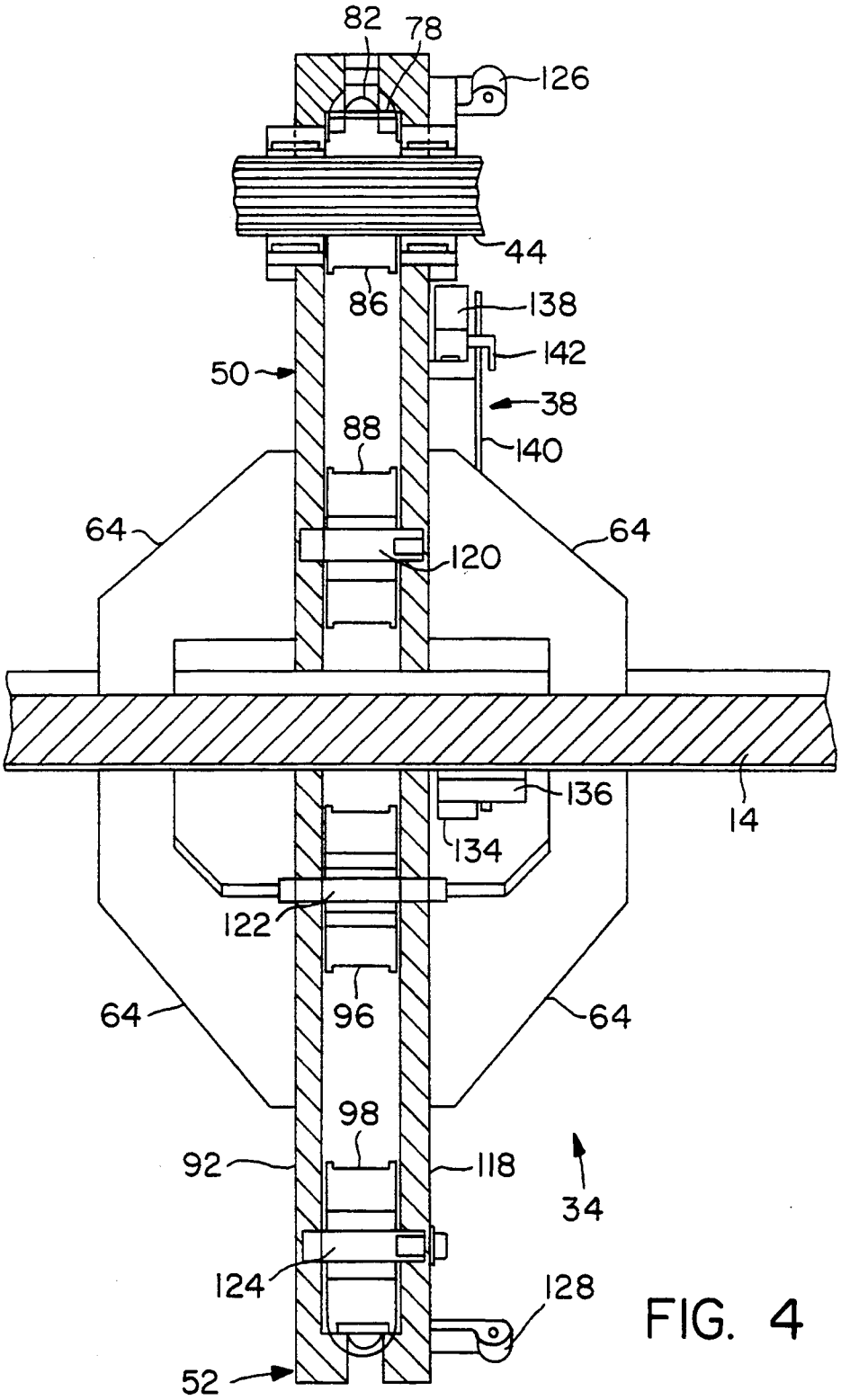
FIG. 4 is a sectional view of the paper feed mechanism of FIG. 3 taken along the line 4—4 thereof.
Figure 5:
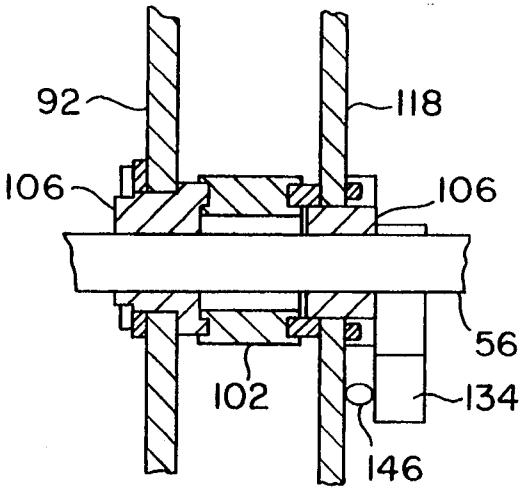
FIG. 5 is a sectional view of the paper feed mechanism of FIG. 3 taken along the line 5—5 thereof and showing a pulley with eccentric mount which forms a part of the pitch adjustment arrangement of FIG. 2.

The sectional view of FIG. 4 which is taken along the line 4—4 of FIG. 3 illustrates further details of the paper feed mechanism 34 including the spaced apart side frames 92 and 118, the manner in which the shafts 120, 122 and 124 extend between the side frames 92 and 118 so as to rotatably mount the pulleys 88, 96 and 98 therebetween, and the manner in which the lateral support legs 64 at the opposite sides of the upper and lower portions 50 and 52 extend outwardly and into contact with the platen 14. The side frames 92 and 118 are spaced apart by an amount sufficient to rotatably mount the pulleys 86, 88, 96 and 98 therebetween. The lateral support legs 64 extend outwardly to locations at the platen 14 which are spaced apart by a distance several times the width of the paper feed mechanism 34, providing substantial lateral support for the paper feed mechanism 34 as mounted on the platen 14 while maintaining the paper feed mechanism 34 generally perpendicular to the platen 14.

Figure 6:
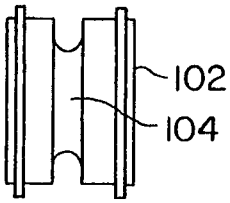
FIG. 6 is a front view of the pulley of FIG. 5.

FIG. 5 is a sectional view of FIG. 3 taken along the line 5—5 thereof, and FIG. 6 is a front view of the pitch adjustment pulley 102. As previously noted, and as shown in FIG. 6, the pitch adjustment pulley 102 is provided with the circumferential groove 104 which extends around a central portion of the circumference of the pitch adjustment pulley 102. The groove 104 receives the pins 82 as the belt 78 extends around the pitch adjustment pulley 102, as shown in FIG. 2.

As shown by the sectional view of FIG. 5, the pitch adjustment pulley 102 is rotatably mounted between the side frames 92 and 118 by the eccentric hub 106. The eccentric hub 106 is comprised of opposite portions rotatably disposed within the side frames 92 and 118. Rotation of the pitch adjustment shaft 56 produces a shifting of the axis of rotation of the pitch adjustment pulley 102 relative to the side frames 92 and 118 through action of the eccentric hub 106. As described in connection with FIG. 2, such shifting of the axis of rotation of the pitch adjustment pulley 102 has the effect of varying the length of the endless path of movement 80 for the endless belt 78 between the upper and lower portions 50 and 52 so as to act in conjunction with the belt tension provided by the spring 112 and the pulley 108 to provide pitch adjustment.

Figure 8:
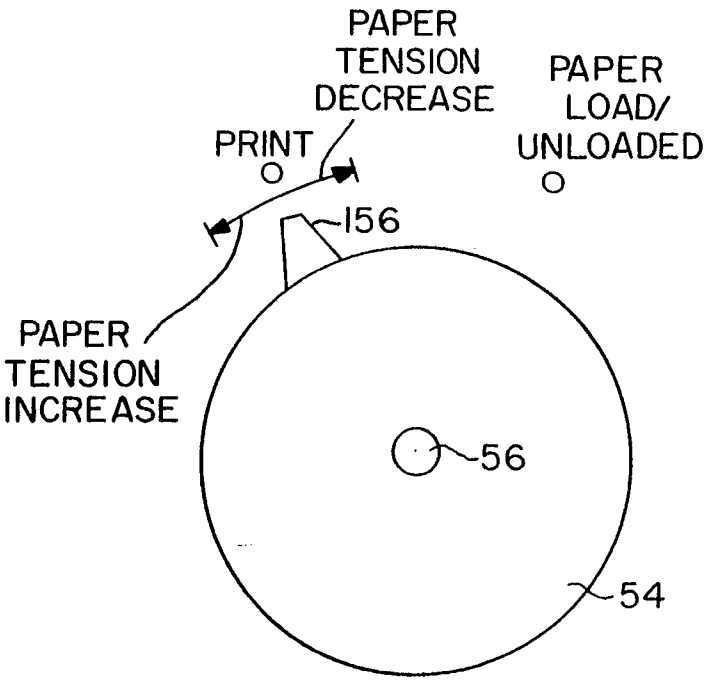
FIG. 8 is an end view of the knob arrangement of FIG. 7 showing the different rotational positions of the knob as it relates to adjustment of pitch to vary paper tension.
Figure 7:
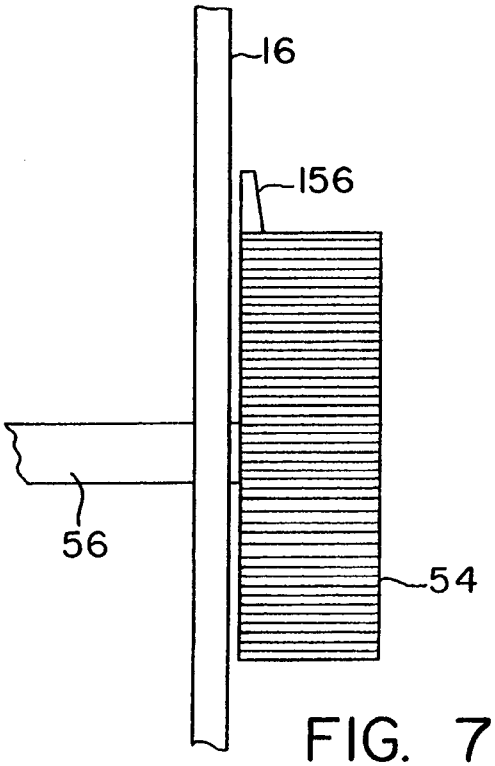
FIG. 7 is a side view of a knob arrangement for adjusting the pitch of the paper feed system of FIG. 1.

As previously described, rotation of the pitch adjustment shaft 56 to provide pitch adjustment is controlled by the knob 54. The knob 54 is shown in FIGS. 7 and 8. The knob 54 which is coupled to the pitch adjustment shaft 56 rotates the pitch adjustment shaft 56 through an arc of movement between a basic paper tension or PRINT position and a tension release or PAPER LOAD/UNLOAD position as shown in FIG. 8.

The knob 54 has a pointer 156 which is moved into the tension release or PAPER LOAD/UNLOAD position shown in FIG. 8 to facilitate loading and unloading of the length of print paper 30. Rotation of the knob 54 to move the pointer 156 into the tension release or PAPER LOAD/UNLOAD position rotates the pitch adjustment shaft 56 to a position in which there is no tension in the paper 30 within the print station 28 between the upper and lower portions 50 and 52 of each of the paper feed mechanisms 34 and 36. Following loading of the length of print paper 30, the knob 54 is rotated into the basic tension or PRINT position. This rotates the pitch adjustment shaft 56 into a position in which the paper web between the upper and lower portions 50 and 52 within the print station 28 is placed in a nominal amount of tension. Minor variations in the nominal amount of tension to provide fine tuning are accomplished using the knob 54 which is rotatable through a small arc of movement surrounding the PRINT or nominal tension position. Rotation of the knob 54 in a counter-clockwise direction as viewed in FIG. 8 to move the pointer 156 slightly to the left of the PRINT position provides slight increases in the paper tension, and vice versa.

The operation of the releasable locking arrangement 38 which was described in connection with FIG. 3 is shown in FIGS. 9 and 10. As previously noted, the design of the releasable locking arrangement 38 provides a useful mechanical advantage. The link 140 is coupled to the locking member 134 at a pivot location 168 which is a fixed first distance from a pivot location 170 for the locking member 134. The link 140 is coupled to the manually rotatable actuating lever 138 at a pivot location 172 which is a given second distance from a pivot location 174 for the actuating lever 138. The first distance between the pivot locations 168 and 170 is substantially greater than the second distance between the pivot locations 172 and 174. Consequently, manual rotation of the actuating lever 138 by a given amount produces rotation of the locking member 134 by a smaller amount. In this manner the locking member 134 can be rotated in response to rotation of the actuating lever 138 to securely position the portion 136 against the platen 14, and at the same time produce unlocking or release when desired.

In the locked position of the releasable locking arrangement 38 shown in FIG. 9, the manually rotatable actuating lever 138 is maintained in the generally horizontal locking position shown by the second tension spring 146. This causes the locking member 134 to be held in the locked position against the resistance of the first tension spring 142, with the portion 136 firmly wedged against the underside of the platen 14.

Unlocking of the releasable locking arrangement 38 is produced by upward rotation of the manually rotatable actuating lever 138. As the actuating lever 138 is rotated upwardly, a point is reached at which the second tension spring 146 acts to pull the actuating lever 138 into and hold the lever 138 in the unlocking position shown in FIG. 10. Simultaneously with such movement, the link 140 rotates the locking member 134 in a direction to release the portion 136 from the underside of the platen 14, which motion is encouraged by the tension of the first tension spring 142.

When it is desired to again lock the releasable locking arrangement 38, the manually rotatable actuating lever 138 is rotated downwardly into the locking position shown in FIG. 9. This causes the link 140 to lift up on the locking member 134 against the resistance of the first tension spring 142 so as to cam the portion 136 against the underside of the platen 14.

Figure 11:
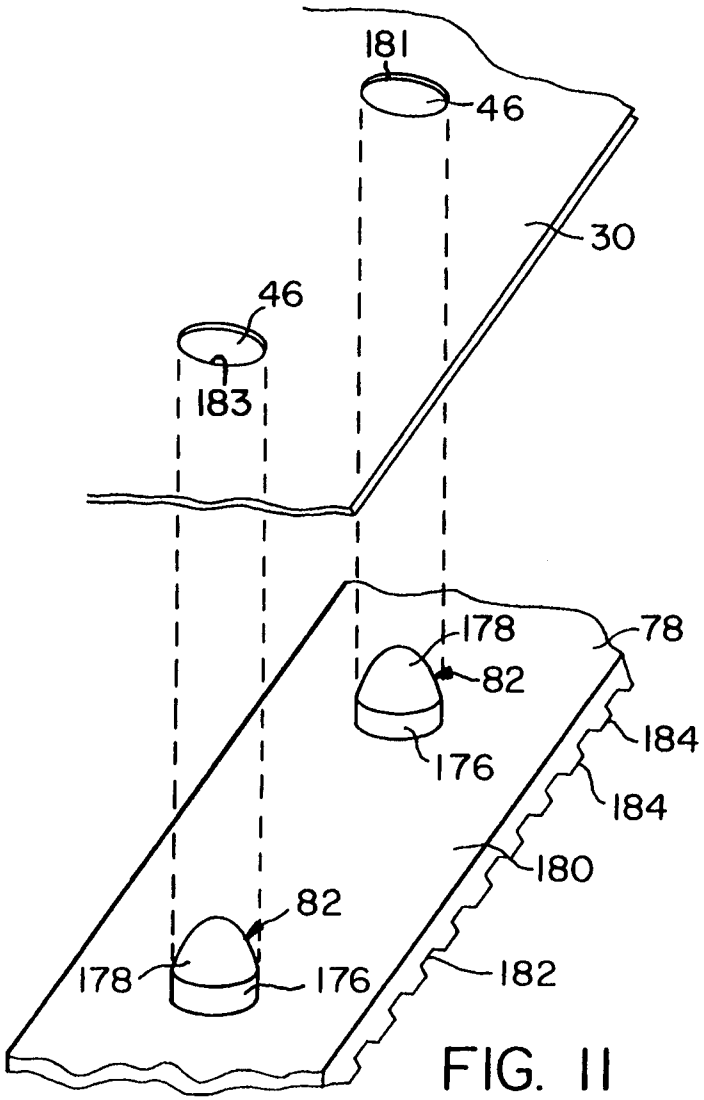
FIG. 11 is a perspective view of a portion of an endless belt within one of the paper feed mechanisms of the paper feed system of FIG. 1 showing the nature of pins spaced along the length of the belt and the manner in which such pins interface with apertures at the opposite edges of a length of print paper.

FIG. 11 illustrates a portion of the endless belt 78 with two of the pins 82 thereon. The pins 82 are located in spaced apart fashion along a central portion of the length of the belt 78, and may be either integrally formed with the belt 78 or separately fashioned and then mounted on the belt 78. The pins 82 are of like size and configuration, and each includes a generally cylindrical base portion 176 adjacent a top surface 180 of the belt 78. Each of the pins 82 terminates in an involute portion 178 extending outwardly from the cylindrical base portion 176 opposite the top surface 180 of the belt 78. The involute portion 178 of the pins 82 helps to ease movement of the pin 82 into and out of the apertures 46 at the edges of the length of print paper 30. Each of the apertures 46 in the paper 30 has a diameter slightly greater than that of the cylindrical base portion 176 of the pins 82. With paper tension properly set, the base portions 176 of the pins 82 at the upper portion 50 of the paper feed mechanism 34 bear against upper edges 181 of the mating apertures 46 at the edges of the length of print paper 30 while the base portions 176 of the pins 82 at the lower portion 56 of the paper feed mechanism 34 bear against lower edges 183 of the mating apertures 46 at the edges of the length of paper 30.

Figure 13:
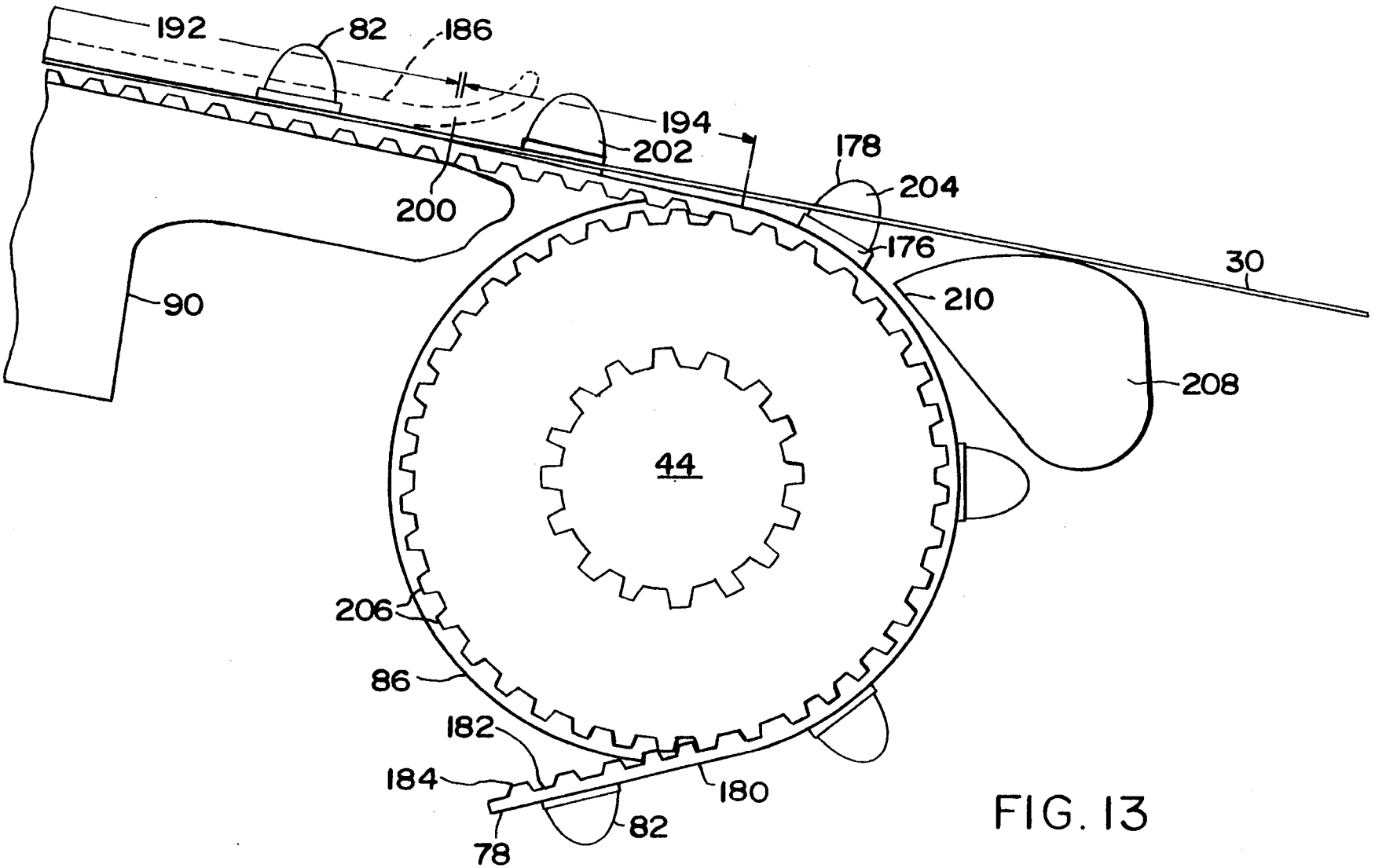
FIG. 13 is an enlarged view of a portion of the paper feed mechanism of FIG. 2 illustrating the manner in which a ramp portion thereof acts to remove the pins on the belt from the apertures at the edge of a length of print paper in advantageous fashion.

An underside 182 of the belt 78 opposite the top surface 180 is provided with a succession of spaced apart teeth 184 which mesh with teeth 206 on the outer surface of the drive pulley 86 as described hereafter in connection with FIG. 13.

Figure 12:
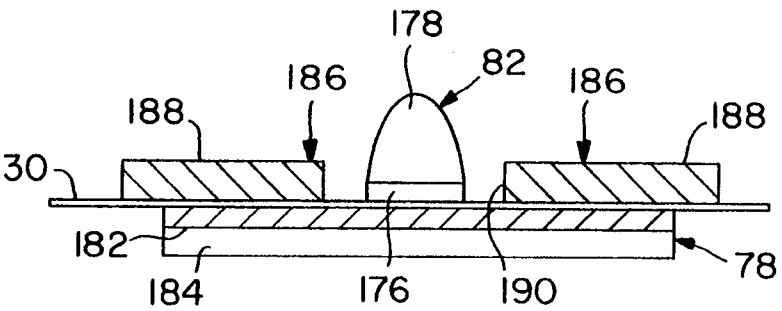
FIG. 12 is a sectional view of the belt of FIG. 11 showing the manner in which an edge of a length of print paper is positioned and maintained thereon by a resiliently mounted slide member.

FIG. 12 is a sectional view of the belt 78 and the length of print paper 30 illustrating the desired position for feeding the length of print paper 30 in which the length of print paper 30 resides against the top surface 180 and the apertures 46 therein are positioned over the cylindrical base portions 176 of the pins 82. As described hereafter the length of print paper 30 is maintained in such position along the side portions 84 and 94 of the endless path of movement 80 for the belt 78 using the slide members 186 mounted at the undersides of the hinged covers 62. One such slide member 186 is shown in partial section in FIG. 12. The slide member 186 includes opposite portions 188 disposed on opposite sides of a slot 190 therebetween for accommodating the pins 82. The opposite portions 188 of the slide member 186 are resiliently biased in the downward direction so as to maintain the length of print paper 30 against opposite edge portions of the belt 78.

Referring again to FIG. 2 the length of print paper 30 is shown therein as extending all of the way through the paper feed mechanism 34. As such, the length of print paper 30 extends along the side portion 94 of the endless path of movement 80 for the belt 78 within the lower portion 52, then through the print station 28 defined by the interface between the platen 14 and the hammerbank 22 adjacent the ribbon mask 76 and the length of ink ribbon 26, then along the side portion 84 of the endless path of movement 80 for the endless belt 78 within the upper portion 50. The side portions 84 and 94 form a relatively small acute angle with each other at the print station 28, as previously described. In addition to allowing for a short web of paper 30 between the side portions 84 and 94, such angulation wraps the paper 30 around the platen 14 for better print positioning of the paper 30.

The side portion 84 within the upper portion 50 of the paper feed mechanism 34 is provided with a straight paper feed portion 192 which extends from the pulley 88 along most of the length of the belt support member 90. To facilitate engagement and disengagement of the length of print paper 30 by the pills 82 at the upper end of the paper feed mechanism 34, the side portion 84 also includes a ramp portion 194 which extends from the upper end of the belt support member 90 to the drive pulley 86 and which forms a relatively small acute angle with the straight paper feed portion 192. The side portion 94 within the lower portion 52 includes a straight paper feed portion 196 extending from the pulley 96 to the lower end of the belt support member 100 and a ramp portion 198 to facilitate engagement and disengagement of the length of print paper 30 by the pins 82. The ramp portion 198 extends downwardly from the lower end of the belt support member 100 to the pulley 98 and forms a relatively small acute angle with the straight paper feed portion 196. The angles of the ramp portions 194 and 198 are selected in relation to the lengths thereof so that each of the pins 82 is partially but not completely withdrawn from the apertures 46 in the length of print paper 30 as the pin 82 travels along the ramp portion 194 to the drive pulley 86 (or along the ramp portion 198 to the pulley 98 in the event that the length of print paper 30 is moving downwardly instead of upwardly). Partial removal of each of the pins 82 as it travels along the ramp portions 194 and 198 prevents tearing of the paper 30. At the same time partial but not complete withdrawal of the pins 82 upon reaching the pulley 86 (or the pulley 98) provides an additional drive which is useful in feeding the length of print paper 30 in the most effective manner.

The ramp portion 194 within the upper portion 50 is shown in greater detail in FIG. 13. As shown in FIG. 13, the straight paper feed portion 192 terminates at a location 200 along the belt support member 90. At the location 200 the belt 78 and the pins 82 enter the ramp portion 194 which extends from the location 200 to the point of tangent contact with the drive pulley 86. It will be seen that the ramp portion 194 is relatively straight and forms a relatively small acute angle with the straight paper feed portion 192. This angle is chosen so as to partially but not completely remove the pins 82 from the apertures 46 in the length of print paper 30 as the pins 82 move from the straight paper feed portion 192 to the drive pulley 86. More specifically, the angle between the ramp portion 194 and the straight paper feed portion 192 is selected in relation to the length of the ramp portion 194 so as to withdraw the cylindrical base portion 176 of each pin 82 but not the involute portion 178 of the pin 82 as the pin travels to the end of the ramp portion 194 at the drive pulley 86. The angle of the ramp portion 194 is chosen so as to move the length of print paper 30 from the top surface 180 of the belt 78 approximately to the juncture between the cylindrical base portion 176 and the involute portion 178 of the pin 82 when the pin 82 reaches the drive pulley 86 at the end of the ramp portion 194.

In the particular illustration of FIG. 13, a particular one 202 of the pins 82 has just entered the ramp portion 194 and this has caused the cylindrical base portion 176 thereof to be partially withdrawn from the mating aperture in the length of print paper 30. A second one 204 of the pins 82 which immediately precedes the particular one 202 of the pins 82 has just passed the end of the ramp portion 194, and consequently the mating aperture 46 in the length of print paper 30 has moved just above the juncture between the cylindrical base portion 176 and the involute portion 178. The involute portion 178 of the second one 204 of the pins 82 then facilitates removal of the second one 204 of the pins 82 from the mating aperture 46 in the length of print paper 30 as the second one 204 of the pins 82 begins to travel around the drive pulley 86.

Paper tearing may occur in instances where the pins 82 begin to travel around a pulley with the cylindrical base portions 176 thereof still inserted within the mating apertures 46 in the length of print paper 30. The angle of the ramp portion 194 prevents this by completely removing the cylindrical base portion 176 of each pin 82 from the mating aperture 46 in the length of print paper 30 as the pin 82 reaches the end of the ramp portion 194 and begins to travel around the drive pulley 86. Again, however, the angle of the ramp portion 194 is such that the involute portion 178 of each pin 82 remains within the paper aperture 46 as the pin 82 begins to travel around the drive pulley 86. The extent of sloping of the ramp portion 194 relative to the adjoining straight paper feed portion 192 is equal to the height of the cylindrical base portion 176 of each of the pins 82. When the length of print paper 30 is fed in a downward direction, the action of the ramp portion 194 combines with that of the involute portions 178 of the pins 82 to facilitate insertion of the pins 82 within the apertures 46 in the length of paper 30.

The ramp portion 198 at the lower end of the paper feed mechanism 34 operates in like fashion to the ramp portion 194 at the upper end of the paper feed mechanism 34. The ramp portion 198 facilitates pin insertion in the paper apertures 46 during upward feeding of the paper 30 and pin removal during downward feeding of the paper 30.

As previously described the underside 182 of the endless belt 78 is provided with a succession of teeth 184. The drive pulley 86 is provided at the outer surface thereof with a succession of teeth 206 which mesh with the teeth 184 at the underside 182 of the belt 78 as the belt 78 travels around the pulley 86. The inter-meshing teeth 184, 206 of the drive belt 78 and the drive pulley 86 provide for a positive feed of the length of print paper 30.

Figure 18:
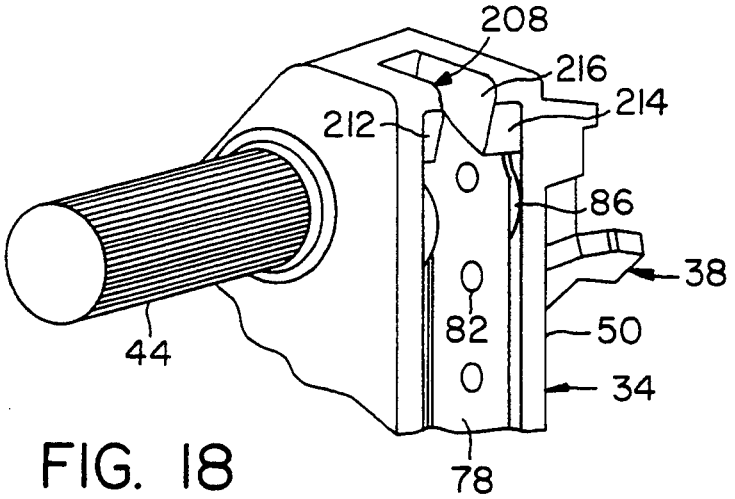
FIG. 18 is a perspective view of an upper portion of one of the paper feed mechanisms of the paper feed system of FIG. 1 illustrating a lug arrangement for maintaining the toothed underside of the endless belt of the paper feed mechanism in engagement with a toothed drive pulley.

To prevent the teeth 184 at the underside 182 of the belt 78 from disengaging the teeth 206 on the drive pulley 86 so that the belt 78 slips relative to the drive pulley 86, particularly during manual tearing off of a section of the paper 30 from the remaining paper in the printer, each of the paper feed mechanisms 34 and 36 is provided with a lug arrangement 208 which is shown in FIG. 13 as well as in FIGS. 2 and 18. The lug arrangement 208 is disposed adjacent the top surface 180 of the belt 78 at a location part way around the drive pulley 86. As shown in FIG. 13 the lug arrangement 208 has a portion 210 thereof which is disposed relatively close to the top surface 180 of the belt 78 when the teeth 184 at the underside 182 of the belt 78 are fully engaged with the teeth 206 on the pulley 86. If the teeth 184 at the underside 182 of the belt 78 begin to withdraw from the teeth 206 on the pulley 86 as the belt 78 travels around the pulley 86, the portion 210 of the lug arrangement 208 engages the top surface 180 of the belt 78 before the belt 78 can move outwardly far enough to disengage the teeth 184 at the underside 182 thereof from the teeth 206 on the drive pulley 86. The portion 210 of the lug arrangement 208 is spaced from the drive pulley 86 by a distance greater than the thickness of the belt 78 but less than the sum of the belt thickness and the height of the teeth 184 and 206.

As shown in FIG. 18 the lug arrangement 208 is comprised of a pair of opposite spaced apart lugs 212 and 214 integrally formed with the side frames 92 and 118 respectively. The spaced apart lugs 212 and 214 have a space 216 therebetween through which the pins 82 may pass. As such, the lugs 212 and 214 are disposed adjacent the opposite sides of the endless belt 78.

Figure 14:
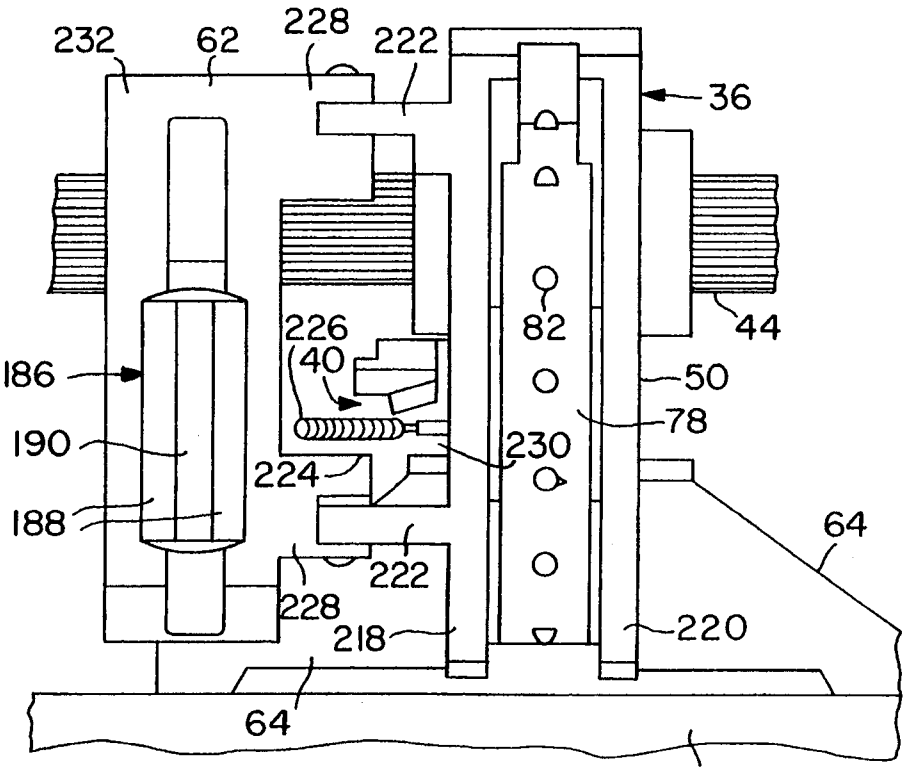
FIG. 14 is a front view of a portion of one of the paper feed mechanisms of the paper feed system of FIG. 1 with the cover thereof open to show the bottom of a slide member mounted within the cover.

FIG. 14 shows the upper portion 50 of the paper feed mechanism 36 with the hinged cover 62 thereof in the open position. The hinged cover 62 is coupled to a side frame 218 of the paper feed mechanism 36 opposite another side frame 220 by a pair of hinges 222 extending from the side frame 218. A coil spring 224 extending between a post 226 on a lower one of a pair of hinges 228 of the hinged cover 62 and a pin 230 on the side frame 218 assists in maintaining the hinged cover 62 either in the open position shown in FIG. 14 or in a closed position in which the hinged cover 62 resides over the upper portion 50 of the paper feed mechanism 36.

As previously described in connection with FIG. 12, each of the hinged covers 62 is provided with one of the slide members 186. The slide members 186 have portions 188 on the opposite sides of a pin slot 190 for disposition against the opposite sides of the belt 78 with the length of print paper 30 disposed therebetween. In this manner the slide members 186 maintain the apertures 46 in the length of paper 30 over the cylindrical portions 176 at the bases of the pins 82.

The slide member 186 is mounted within the hinged cover 62 so as to be resiliently biased from an underside 232 of the hinged cover 62 toward the belt 78 when the hinged cover 62 is closed over the upper portion 50. The slide member 186 is mounted within the hinged cover 62 so that a major portion thereof comprised of the opposite portions 188 protrudes from the underside 232.

Figure 15:
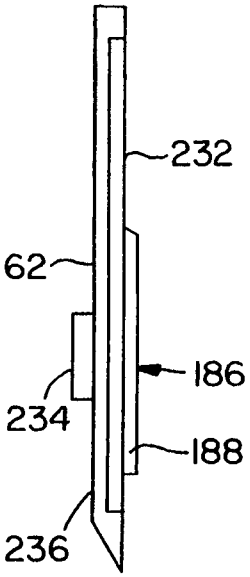
FIG. 15 is a side view of the cover of FIG. 14.

FIG. 15 is an end view of the hinged cover 62 showing one of the two opposite portions 188 of the slide member 186 as they protrude from the underside 232 of the hinged cover 62. As shown in FIG. 15 a cylindrical portion 234 extends outwardly from an upper surface 236 of the cover 62 opposite the underside 232 to house and provide access to an arrangement for resiliently biasing the slide member 186 as described hereafter in connection with FIG. 17.

Figure 17:
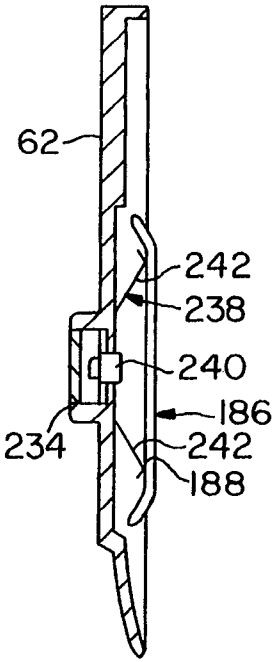
FIG. 17 is a sectional view of the cover shown in FIG. 16 taken along the line 17—17 thereof.
Figure 16:
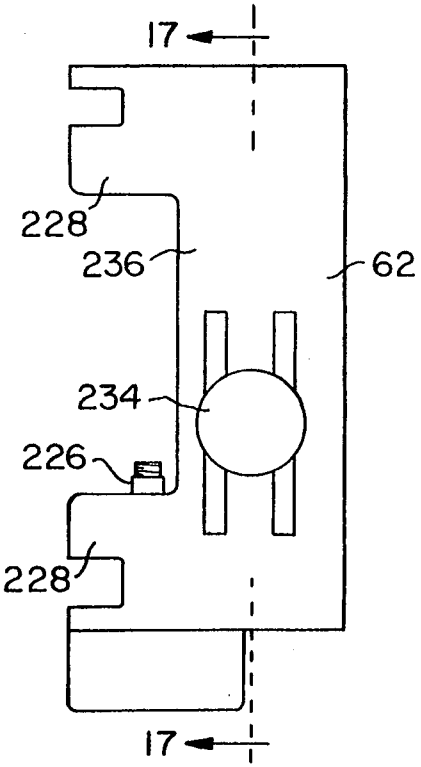
FIG. 16 is a front view of the cover of FIG. 14.

The front of the hinged cover 62 including the upper surface 236 thereof is shown in FIG. 16. FIG. 17 is a sectional view of the hinged cover 62 of FIG. 16 taken along the line 17—17 thereof. As shown in FIG. 17, the hinged cover 62 has a hollow interior in which the slide member 186 is mounted. Biasing of the slide member 186 in a direction out of the underside 232 of the hinged cover 62 is provided by a spring 238 mounted at the base of the cylindrical portion 234 by a fastener 240 and having an opposite pair of leg portions 242 extending downwardly and outwardly and into contact with the opposite portions 188 of the slide member 186.

Figure 19:
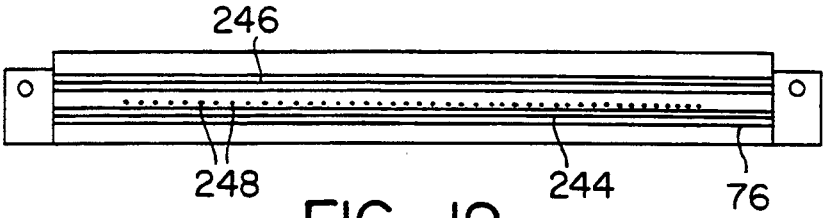
FIG. 19 is a plan view of the ribbon mask showing a pair of parallel ridges thereon which form guides for aiding in the feeding of a length of print paper through the paper feed system of FIG. 1.
Figure 20:
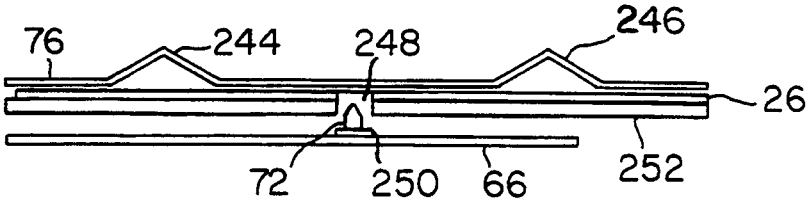
FIG. 20 is an end view of the ribbon mask of FIG. 19.

To facilitate loading of the length of print paper 30 into the paper feed mechanisms 34 and 36, a guide arrangement is provided as shown in FIGS. 19 and 20 as well as in FIG. 2. FIG. 19 shows the portion of the ribbon mask 76 for the hammerbank 22 which faces the platen 14 and which is disposed within the print station 28. Extending along the length of the ribbon mask 76 are a pair of parallel, spaced apart ridges 244 and 246. Because the ridges 244 and 246 extend along the entire length of the ribbon mask 76, such ridges 244, 246 are disposed in their operative positions adjacent the paper feed mechanisms 34 and 36 regardless of the locations of the paper feed mechanisms 34 and 36 along the length of the platen 14.

The ridges 244 and 246 facilitate the loading of paper 30 through the angled, non-planar configuration of the upper and lower portions 50 and 52 of the paper feed mechanisms 34 and 36. The manner in which the ridges 244 and 246 function as paper guides can be better understood by referring to FIG. 2. The ridge 244 forms a paper guide at the entrance to the space at the lower side of the platen 14 and is spaced from the platen-14 by a small distance. As the length of print paper 30 is fed upwardly through the lower portion 52 of the paper feed mechanism 34, the ridge 244 assists in guiding the leading edge of the length of print paper 30 through the slight angular bend required to enter the print station 28 between the platen 14 and the ribbon mask 76 of the hammerbank 22. Among other things, the ridge 244 prevents the leading edge of the length of print paper 30 upon reaching the end of the hinged cover 62 (shown in dotted outline in FIG. 2) from curling over the end of the hinged cover 62 and away from the print station 28.

At the opposite side of the print station 28, the ridge 246 assists in directing the leading edge of the length of print paper 30 into the upper portion 50 of the paper feed mechanism 34. In particular, the ridge 246 prevents the leading edge of the length of print paper 30 from feeding into the space between the hinged cover 62 at the upper portion 50 and the hammerbank cover 76.

The ridges 244 and 246 function in a similar manner as paper guides when feeding paper in the reverse or downward direction as well as when feeding paper in the upward direction.

FIG. 20 is an end view of the ribbon mask 76 showing the manner in which the ridges 244 and 246 are formed therein. The ribbon mask 76 is disposed between and protects the platen supported paper 30 (not shown in FIG. 20) from the ribbon 26, except for a plurality of apertures 248 in the ribbon mask 76 which are spaced apart along the length of the ribbon mask 76 (as shown in FIG. 19) and which are aligned with the dot printing impact tips 72 on the hammers 66. Also aligned with the dot printing impact tips 72 are apertures 250 in a cover 252 mounted on the hammerbank 22 and disposed on the opposite side of the ribbon 26 from the ribbon mask 76 and adjacent the hammers 66. As each hammer 66 is released or "fired", the dot printing impact tip 72 thereon extends through the aperture 250 in the cover 252 and through the aperture 248 in the ribbon mask 76 to impact the ribbon 26 against the paper 30.

Figure 21:
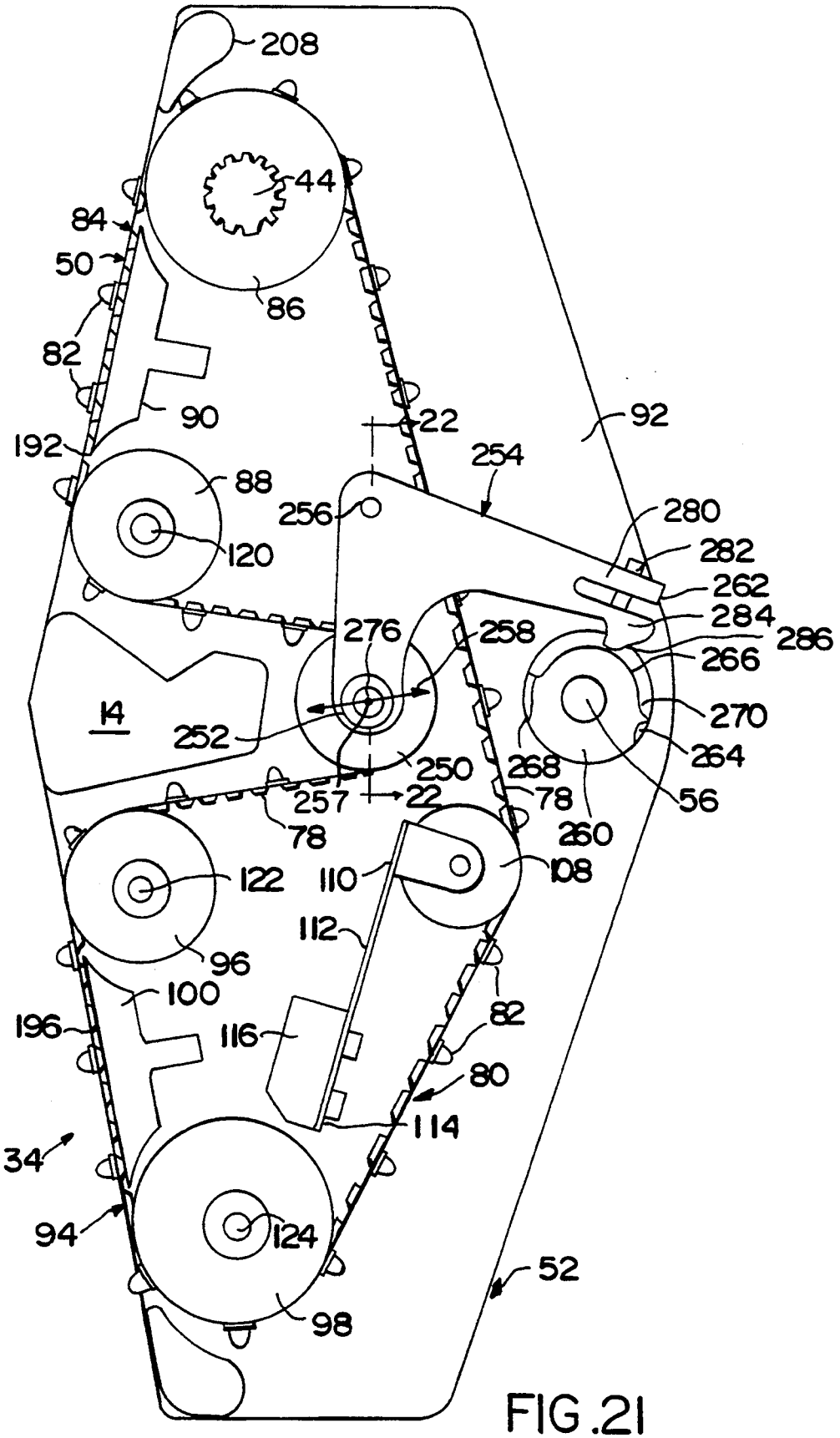
FIG. 21 is a side view of the inside of one of the paper feed mechanisms of the paper feed system of FIG. 1 showing a preferred second embodiment of an arrangement for providing pitch adjustment.

FIG. 21 is a side view of the paper feed mechanism 34 similar to that of FIG. 2. However, in the example of FIG. 21, the paper feed mechanism 34 is provided with a preferred second embodiment of an arrangement for varying the length of the endless path of movement 80 for the belt 78 in order to vary the pitch. The particular arrangement shown in FIG. 21 includes a pitch adjustment pulley 250 rotatably mounted at a first end 252 of a pivotable lever arm assembly 254. The pitch adjustment pulley 250 engages a portion of the endless belt 78 between the pulleys 88 and 96 of the upper and lower portions 50 and 52 respectively of the paper feed mechanism 34.

The pivotable lever arm assembly 254 is mounted for pivoting movement about a pivot pin 256 mounted so as to extend between the side frames 92 and 118 of the paper feed mechanism 34 as shown in FIG. 22. Rotation of the pivotable lever arm assembly 254 about the pivot pin 256 causes an axis of rotation, 257 of the pitch adjustment pulley 250 to shift along an axis represented by an arrow 258. This varies the length of the endless path of movement 80 of the endless belt 78 to accomplish pitch adjustment.

Pivoting movement of the pivotable lever arm assembly 254 is provided by a rotatable cam 260 which is engaged by a second end 262 of the pivotable lever arm assembly 254 opposite the first end 252. The endless belt 78 tends to pull the axis of rotation of the pitch adjustment pulley 250 to the left as viewed in FIG. 21 so as to maintain the second end 262 of the pivotable lever arm assembly 254 in engagement with the cam 260. The cam 260 which is rotatably disposed within a mating aperture 264 in the side frame 92 is mounted on the pitch adjustment shaft 56. As previously described the pitch adjustment shaft 56 is controlled by the knob 54. Rotation of the knob 54 rotates the pitch adjustment shaft 56 and thereby the cam 260.

The cam 260 has an outer camming surface 266 which engages the second end 262 of the pivotable lever arm assembly 254. The outer camming surface 266 is of varying radius relative to the axis of rotation of the cam 260 around a portion of the circumference thereof. The radius of the outer camming surface 266 increases from a minimum at a first end 268 thereof to a maximum at all opposite second end 270 thereof. Rotation of the cam 260 to position the first end 268 at the second end 262 of the pivotable lever arm assembly 254 pivots the pivotable lever arm assembly 254 so that the pitch adjustment pulley 250 is moved to an extreme left hand position as viewed in FIG. 21. Conversely, when the cam 260 is rotated to position the second end 270 of the outer camming surface 266 thereof at the second end 262 of the pivotable lever arm assembly 254, the pivotable lever arm assembly 254 is pivoted so as to move the pitch adjustment pulley 250 to an extreme right hand position as viewed in FIG. 21.

As previously described in connection with FIG. 8, the knob 54 can be rotated between a low paper tension PAPER LOAD/UNLOAD position and a high paper tension PRINT position. Moreover, the knob 54 can be rotated through a small arc at the PRINT position to accomplish minor variations in paper tension. In the example of FIG. 21, rotation of the knob 54 in a clockwise direction as viewed in FIG. 8 rotates the pitch adjustment shaft 56 and the attached cam 260 in a clockwise direction as viewed in FIG. 21. This positions the second end 262 of the pivotable lever arm assembly 254 at the first end 268 of the outer camming surface 266, thereby moving the pitch adjustment pulley 250 to the extreme left hand position as viewed in FIG. 21 to relax the tension on the endless belt 78 and thereby on the paper. This is the PAPER LOAD/UNLOAD position. If the knob 54 is now rotated in a counterclockwise direction as seen in FIG. 8, the pitch adjustment shaft 56 and the cam 260 are rotated in the counterclockwise direction as viewed in FIG. 21, so that the second end 262 of the pivotable lever arm assembly 254 eventually resides at the second end 270 of the outer camming surface 266. This moves the pitch adjustment pulley 250 to the extreme right hand position as viewed in FIG. 21 to provide the desired belt tension corresponding to the PRINT position. As described in connection with FIG. 8, minor variations in the rotational position of the knob 54 can be made to provide minor variations in paper tension when the knob 54 is in the PRINT position.

FIG. 22 is a sectional view of a portion of the arrangement of the paper feed mechanism 34 shown in FIG. 21. As shown in FIG. 22, the pivotable lever arm assembly 254 is comprised of a pair of opposite, spaced apart members 272 and 274 mounted for rotation about the pivot pin 256 and having a pin 276 extending therebetween at the first end 252 of the pivotable lever arm assembly 254. The pitch adjustment pulley 250 which is disposed between the members 272 and 274 is rotatably mounted on the pin 276. As in the case of the pitch adjustment pulley 102 of the arrangement of FIG. 2, the pitch adjustment pulley 250 has a circumferential groove 278 therein for receiving the pins 82 on the endless belt 78.

As shown in FIG. 21 the second end 262 of the pivotable lever arm assembly 254 is split into a main portion 280 thereof in which a threaded set screw 282 is journaled and a separate tab 284 spaced apart from the main portion 280. The tab 284 is resiliently flexible relative to the main portion 280 and is positioned in a selected location relative to the main portion 280 by the set screw 282 which bears against the tab 284. The tab 284 has an opposite protrusion 286 which engages the outer camming surface 266 of the cam 260. The set screw 282 is used to perform initial calibration of the pitch adjustment arrangement of FIG. 21.

Pitch adjustment within the paper feed mechanisms 34 and 36 requires relatively close tolerances. For this reason the arrangement of FIG. 21 with its lever arm action and the resulting ability to position the pitch adjustment pulley 250 more precisely is preferred over the arrangement of FIG. 2.

While the invention has been particularly shown and described with reference to a preferred embodiment thereof, it will be understood by those skilled in the art that various changes in form and details may be made therein without departing from the spirit and scope of the invention.

What is claimed is:

1. A paper feed mechanism for feeding a length of paper through a print station comprising the combination of an endless paper feed member for engaging a length of paper to feed the length of paper through a print station, means defining an endless path of movement for the paper feed member, the endless path of movement including a pair of side portions disposed adjacent the print station on opposite sides of the print station, means for varying the length of the endless path of movement between the pair of side portions thereof, and means within the endless path of movement for resiliently biasing and thereby tensioning the endless paper feed member, the means for varying the length of the endless path of movement between the pair of side portions thereof comprising a rotatable cam, a pivotable lever arm assembly engaging the cam and a pulley rotatably mounted on the pivotable lever arm assembly and engaging the endless paper feed member.

2. A paper feed mechanism for feeding a length of paper through a print station, the paper having a succession of apertures therein, comprising the combination of an endless belt having a plurality of pins thereon spaced apart along the endless belt for engaging the succession of apertures in the length of paper, means defining an endless path of movement for the endless belt, the endless path of movement including a pair of side portions disposed adjacent the print station on opposite sides of the print station, means within the endless path of movement for resiliently biasing and thereby tensioning the endless belt, a pitch adjustment pulley having an axis of rotation and engaging the endless belt and means for shifting the axis of rotation of the pitch adjustment pulley, the means for shifting the axis of rotation of the pitch adjustment pulley including a shaft disposed between the pair of side portions of the endless path of movement adjacent the print station, a sleeve eccentrically mounted on the shaft, and means for turning the shaft to a desired rotational position, the pitch adjustment pulley being rotatably mounted on the sleeve.

3. A paper feed mechanism for feeding a length of paper through a print station, the paper having a succession of apertures therein, comprising the combination of an endless belt having a plurality of pins thereon spaced apart along the endless belt for engaging the succession of apertures in the length of paper, means defining an endless path of movement for the endless belt, the endless path of movement including a pair of side portions disposed adjacent the print station on opposite sides of the print station, means within the endless path of movement for resiliently biasing and thereby tensioning the endless belt, a pitch adjustment pulley having an axis of rotation and engaging the endless belt and means for shifting the axis of rotation of the pitch adjustment pulley, the means for shifting the axis of rotation of the pitch adjustment pulley including a rotatable cam and a pivotable lever arm assembly rotatably mounting the pitch adjustment pulley on a first end thereof and having an opposite second end engaging the cam.

4. The invention set forth in claim 3, wherein the second end of the pivotable lever arm assembly is comprised of a main portion, a separate tab engaging the cam and a threaded set screw journaled in the main portion and extending into the tab, rotation of the set screw varying the location of the tab relative to the main portion to perform initial calibration.

5. A paper feed system for feeding a length of paper through a print station at an elongated platen comprising the combination of at least one paper feed mechanism mounted on the elongated platen and having opposite portions thereof extending on opposite sides of the elongated platen and engaging a length of paper, the at least one paper feed mechanism being slidable along the elongated platen and including means for selectively locking the paper feed mechanism at a selected location along the elongated platen, the opposite portions of the paper feed mechanism being of elongated configuration and lying along a common axis of elongation which is substantially perpendicular to the elongated platen, and the paper feed mechanism including two different pairs of lateral support members, each pair extending outwardly at opposite sides of a different one of the opposite portions of the paper feed mechanism and into contact with the elongated platen to provide the paper feed mechanism with lateral stability.

6. A arrangement for releasably locking a paper feed mechanism on a platen comprising the combination of a locking member pivotally mounted on the paper feed mechanism and having a portion for engaging the platen to lock the paper feed mechanism thereto, a manually rotatable actuating lever mounted on the paper feed mechanism, an elongated link coupled to the locking member and to the actuating lever, and a tension spring coupled between the locking member and the paper feed mechanism to normally bias the portion for engaging of the locking member away from the platen.

7. A paper feed mechanism for feeding a length of paper having a succession of apertures therein, comprising a rotatable pulley, an elongated paper feed member extending along a paper feed region and around the rotatable pulley and having a plurality of spaced apart pins thereon for disposition in the apertures in the length of paper, the paper feed region having a relatively straight paper feed portion thereof and a relatively straight ramp portion thereof, the ramp portion extending between the paper feed portion and the pulley and forming an angle with the paper feed portion which is large enough to partially but not completely remove each pin on the belt from a mating aperture in the length of paper as the pin arrives at the pulley in response to movement of the paper feed member, each pin having a generally cylindrical base portion thereof adjacent the paper feed member and terminating in an involute portion and the angle between the paper feed region and the ramp portion being chosen to provide movement of the mating aperture of the length of paper from the paper feed member to a juncture between the generally cylindrical base portion and the involute portion of the pin as movement of the paper feed member advances the pin from a juncture between the feed portion and the ramp portion to the pulley.

8. A paper feed mechanism for feeding a length of paper having a succession of apertures therein, comprising a rotatable pulley, an elongated paper feed member extending along a paper feed region and around the rotatable pulley and having a plurality of spaced apart pins thereon for disposition in the apertures in the length of paper, the paper feed region having a relatively straight paper feed portion thereof and a relatively straight ramp portion thereof the ramp portion extending between the paper feed portion and the pulley and forming an angle with the paper feed portion which is large enough to partially but not completely remove each pin on the belt from a mating aperture in the length of paper as the pin arrives at the pulley in response to movement of the paper feed member, each pin having a generally cylindrical base portion of given height adjacent the paper feed member and terminating in an involute portion, and the ramp portion sloping away from the paper feed portion by the given height of the cylindrical base portion over the length of the ramp portion.

9. A paper feed system comprising the combination of an elongated platen, means defining a print station at a side of the elongated platen, a pair of elongated paper feed mechanisms spaced apart along the elongated platen and each being disposed generally perpendicular to the elongated platen and having first and second paper feed portions disposed on opposite sides of the elongated platen, a first guide disposed at a juncture between the first paper feed portion of each pair of paper feed mechanisms and the print station and a second guide disposed at a juncture between the second paper feed portion of each pair of paper feed mechanisms and the print station, the first and second guides being configured and positioned to insure the feeding of a length of paper between the print station and either of the first and second paper feed portions of the pair of paper feed mechanisms, each of the first and second paper feed portions of each pair of paper feed mechanisms comprising an elongated flexible member for feeding a length of paper and a cover disposed over the elongated flexible member, the first guide being disposed adjacent the ends of covers at the first paper feed portions of the pair of paper feed mechanisms and the second guide being disposed adjacent the ends of covers at the second paper feed portions of the pair of paper feed mechanisms.

10. The invention set forth in claim 9, further including a ribbon mask positioned on an opposite side of the print station from the elongated platen and having a pair of spaced apart ridges thereon generally parallel to each other and to the elongated platen, the ridges comprising the first and second guides.

11. A paper feed system comprising the combination of means defining an elongated print station, a pair of paper feed mechanisms spaced apart along the elongated print station and each having first and second paper feed portions on opposite sides of the elongated print station, the first and second paper feed portions of each of the pair of paper feed mechanisms having straight portions thereof forming a relatively small acute angle with each other at the elongated print station and each of the straight portions including a movable elongated member having pins mounted along the length thereof for engaging apertures at the opposite edges of a length of print paper and extending around a pulley at the elongated print station, and a pair of paper guides disposed between the elongated print station and the first and second paper feed portions of each of the pair of paper feed mechanisms, the guides being operative to direct a length of print paper through a curved paper path between the elongated print station and the first and second paper feed portions of the pair of paper feed mechanisms.

* * * * *